US009422126B2

(12) United States Patent
Kondo et al.

(10) Patent No.: US 9,422,126 B2
(45) Date of Patent: Aug. 23, 2016

(54) SHEET CONVEYANCE DEVICE

(71) Applicants: Hayato Kondo, Ibaraki (JP); Naoki Ogawa, Ibaraki (JP); Yasuhiro Suzuki, Yamagata (JP)

(72) Inventors: Hayato Kondo, Ibaraki (JP); Naoki Ogawa, Ibaraki (JP); Yasuhiro Suzuki, Yamagata (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/869,906

(22) Filed: Apr. 24, 2013

(65) Prior Publication Data

US 2013/0300057 A1 Nov. 14, 2013

(30) Foreign Application Priority Data

Apr. 25, 2012 (JP) ..... 099556/2012

(51) Int. Cl.
*B65H 5/06* (2006.01)
*B41F 21/10* (2006.01)
*B41J 3/60* (2006.01)
(Continued)

(52) U.S. Cl.
CPC ..... *B65H 5/06* (2013.01); *B41F 21/106* (2013.01); *B41J 3/60* (2013.01); *B41J 13/223* (2013.01); *B65H 5/10* (2013.01); *B65H 5/12* (2013.01); *B65H 85/00* (2013.01); *B41P 2213/70* (2013.01); *B65H 2301/132* (2013.01); *B65H 2511/11* (2013.01); *B65H 2513/11* (2013.01);
(Continued)

(58) Field of Classification Search
CPC ..... B65H 5/06; B65H 5/10; B65H 5/12; B65H 85/00; B65H 2301/132; B65H 2301/1321; B41F 21/106; B41F 21/108; B41J 3/60
USPC ..... 271/184, 185, 186, 225, 275, 276, 277, 271/194; 101/229, 230, 231, 232
See application file for complete search history.

(56) References Cited

U.S. PATENT DOCUMENTS 4,165,689 A 8/1979 Giuiuzza
5,365,846 A * 11/1994 Becker ..... 101/230
(Continued)

FOREIGN PATENT DOCUMENTS

CN 1212926 A 4/1999
CN 1846997 A 10/2006
(Continued)

OTHER PUBLICATIONS

Japanese Office Action dated May 24, 2016, Japanese Application No. 2013-061462, 2 pages.

*Primary Examiner* — Ernesto Suarez
(74) *Attorney, Agent, or Firm* — Blakely Sokoloff Taylor & Zafman LLP

(57) ABSTRACT

A sheet conveyance device including first to third conveyance units, independent driving unit, device driving unit, and control unit. The first conveyance unit includes a first holder that holds one edge of a sheet, and conveys the sheet. The second conveyance unit includes a second holder that holds one edge of the sheet, and conveys the sheet. The third conveyance unit is supported to be swingable between a reception position at which it receives the sheet from the first conveyance unit, and a transfer position at which it transfers the sheet to the second conveyance unit. The third conveyance unit includes a third holder that holds the other edge of the sheet conveyed by the first conveyance unit, and conveys the sheet held by the third holder. The independent driving unit drives the first conveyance unit. The control unit adjusts the speed at which the sheet is conveyed.

8 Claims, 13 Drawing Sheets

(51) Int. Cl.

| | |
|---|---|
| ***B41J 13/22*** | (2006.01) |
| ***B65H 85/00*** | (2006.01) |
| ***B65H 5/10*** | (2006.01) |
| ***B65H 5/12*** | (2006.01) |

(52) U.S. Cl.
CPC ..... *B65H 2557/242* (2013.01); *B65H 2801/15* (2013.01)

(56) References Cited

U.S. PATENT DOCUMENTS

| | | | | |
|---|---|---|---|---|
| 6,095,043 | A | 8/2000 | Hartmann et al. | |
| 6,311,613 | B1 * | 11/2001 | Takahashi | 101/118 |
| 6,438,352 | B1 | 8/2002 | Landa et al. | |
| 6,698,350 | B2 * | 3/2004 | Iwamloto | 101/211 |
| 6,827,018 | B1 * | 12/2004 | Hartmann et al. | 101/485 |
| 6,851,360 | B2 * | 2/2005 | Iwamloto | 101/230 |
| 6,912,952 | B1 * | 7/2005 | Landa et al. | 101/230 |
| 2002/0063381 | A1 | 5/2002 | Henn | |
| 2003/0019377 | A1 | 1/2003 | Stephan et al. | |
| 2004/0011229 | A1 | 1/2004 | Iwamoto | |
| 2006/0177256 | A1 | 8/2006 | Buck et al. | |
| 2008/0092760 | A1 | 4/2008 | Helmstadter et al. | |
| 2013/0307212 | A1 * | 11/2013 | Kondo et al. | 271/225 |

FOREIGN PATENT DOCUMENTS

| | | | |
|---|---|---|---|
| DE | 10 2009 048689 | A1 | 5/2010 |
| GB | 1548412 | | 7/1979 |
| JP | S58-219058 | A | 12/1983 |
| JP | S52034802 | | 3/1997 |
| JP | H10-323963 | A | 12/1998 |
| JP | 2002-225227 | A | 8/2002 |
| JP | 200233641 | A | 11/2002 |
| WO | WO-99/61958 | | 12/1999 |

* cited by examiner

SHEET CONVEYANCE DEVICE

BACKGROUND OF THE INVENTION

The present invention relates to a sheet conveyance device which conveys a sheet.

Conventionally, as a sheet conveyance device which conveys a sheet, a sheet conveyance device which includes a sheet reversing unit and is applied to a sheet-fed offset rotary printing press equipped with a reversing mechanism and capable of printing on one or both of the two surfaces of a sheet, has been proposed, as described in Japanese Patent Laid-Open No. 58-219058 (literature 1). In the printing press proposed in literature 1, a sheet conveyance device including a reversing unit is interposed between first and second, adjacent printing units, and performs a selective reversing operation for a sheet conveyed by the sheet conveyance device to allow single-sided printing and double-sided printing on the sheet.

In the printing press described in literature 1, the reversing unit includes a transfer cylinder (reference numeral 17) and impression cylinder (reference numeral 16). In double-sided printing, the trailing edge of a sheet conveyed while the leading edge of the sheet is gripped by the transfer cylinder is gripped by the impression cylinder to convey the sheet with its trailing edge leading, and turn it.

However, in the printing press described in literature 1, when the sheet size is changed, engagement of a gear which drives the impression cylinder is canceled before activation of the printing press, the phase of the impression cylinder relative to the transfer cylinder is changed so that a gripper device of the impression cylinder is opposed to the trailing edge of the sheet held on the transfer cylinder, and then the gear must be engaged again. This increases the operator's burden, and its preparation takes a considerable time.

SUMMARY OF THE INVENTION

It is an object of the present invention to propose a sheet conveyance device which can easily cope with a change in size of a sheet.

In order to achieve the above-mentioned object, according to the present invention, there is provided a sheet conveyance device comprising a first conveyance unit which includes a first holder that holds one edge of a sheet, and conveys the sheet held by the first holder, a second conveyance unit which includes a second holder that holds the one edge of the sheet, and conveys the sheet held by the second holder, a third conveyance unit which is supported to be swingable between a reception position at which the third conveyance unit receives the sheet from the first conveyance unit, and a transfer position at which the third conveyance unit transfers the sheet to the second conveyance unit, the third conveyance unit including a third holder that holds the other edge of the sheet conveyed by the first conveyance unit, and conveying the sheet held by the third holder, an independent driving unit which independently drives the first conveyance unit, a device driving unit which drives an entire device including the second conveyance unit and the third conveyance unit, and a control unit which controls the independent driving unit to adjust a speed at which the third conveyance unit conveys the sheet, based on a dimension of the sheet in a conveyance direction.

According to an aspect of the present invention, even if the sheet size is changed, driving of the first conveyance unit (39) is controlled through the independent driving unit (254) based on the changed dimension of the sheet in the conveyance direction. With this operation, the trailing edge of the sheet with its size changed can be held by the third holder (31*bt*) of the third conveyance unit (31*b*) which swings at a predetermined period.

According to another aspect of the present invention, when the trailing edge of the sheet conveyed by the transport cylinder (39) is held by the third holder (31*bt*) of the third conveyance unit (31*b*), the speed of the transport cylinder (39) is adjusted so that the third holder (31*bt*) of the third conveyance unit (31*b*) which swings at a predetermined period is opposed to the trailing edge of the sheet at the reception position. With this operation, even if the sheet size is changed, the trailing edge of the sheet can reliably be transferred from the transport cylinder (39) to the third conveyance unit (31*b*). Also, the speed of the transport cylinder (39) is adjusted so that the fourth holder (37*a*) of the fourth conveyance unit (37) is opposed to the first holder (39*a*) of the transport cylinder (39) after the sheet is held by the third holder (31*bt*). With this operation, the leading edge of the next new sheet can reliably be transferred from the fourth conveyance unit (37) to the first conveyance unit (39).

According to still another aspect of the present invention, if the dimension of the sheet in the conveyance direction is larger than a standard size (reference size), the rotation speed of the transport cylinder (39) is controlled to be higher than the reference speed after the sheet is received from the fourth conveyance unit (37), and lower than the reference speed after the sheet is transferred from the transport cylinder (39) to the third conveyance unit (31*b*). With this operation, even if the dimension of the sheet in the conveyance direction is large, the leading edge of the next new sheet conveyed from the fourth conveyance unit (37) can reliably be held by the transport cylinder (39) after the trailing edge of the sheet is reliably held while the transport cylinder follows a motion of the third conveyance unit (31*b*). However, if the dimension of the sheet in the conveyance direction is smaller than the standard size, the rotation speed of the transport cylinder (39) is controlled to be lower than the reference speed after the sheet is received from the fourth conveyance unit (37), and higher than the reference speed after the sheet is transferred from the transport cylinder (39) to the third conveyance unit (31*b*). With this operation, even if the dimension of the sheet in the conveyance direction is small, the leading edge of the next new sheet conveyed from the fourth conveyance unit (37) can reliably be held by the transport cylinder (39) after the trailing edge of the sheet is reliably held while the transport cylinder follows a motion of the third conveyance unit (31*b*).

According to still another aspect of the present invention, when the sheet is transferred from the transport cylinder (39) to the third conveyance unit (31*b*), and when the sheet is received from the fourth conveyance unit (37), the transport cylinder (39) is rotated at the reference speed by the independent driving motor (254). This allows reliable reception and transfer of the sheet, regardless of the dimension of the sheet in the conveyance direction.

According to still another aspect of the present invention, if the dimension of the sheet in the conveyance direction is the standard size, the transport cylinder (39) is always rotated at a constant reference speed by the independent driving motor (254). This allows reliable reception and transfer of the sheet with the standard size.

DESCRIPTION OF THE PREFERRED EMBODIMENTS

The present invention will be described in detail below with reference to the accompanying drawings.

(1) First Embodiment

Arrangement of Digital Printing Apparatus

Figure 1:
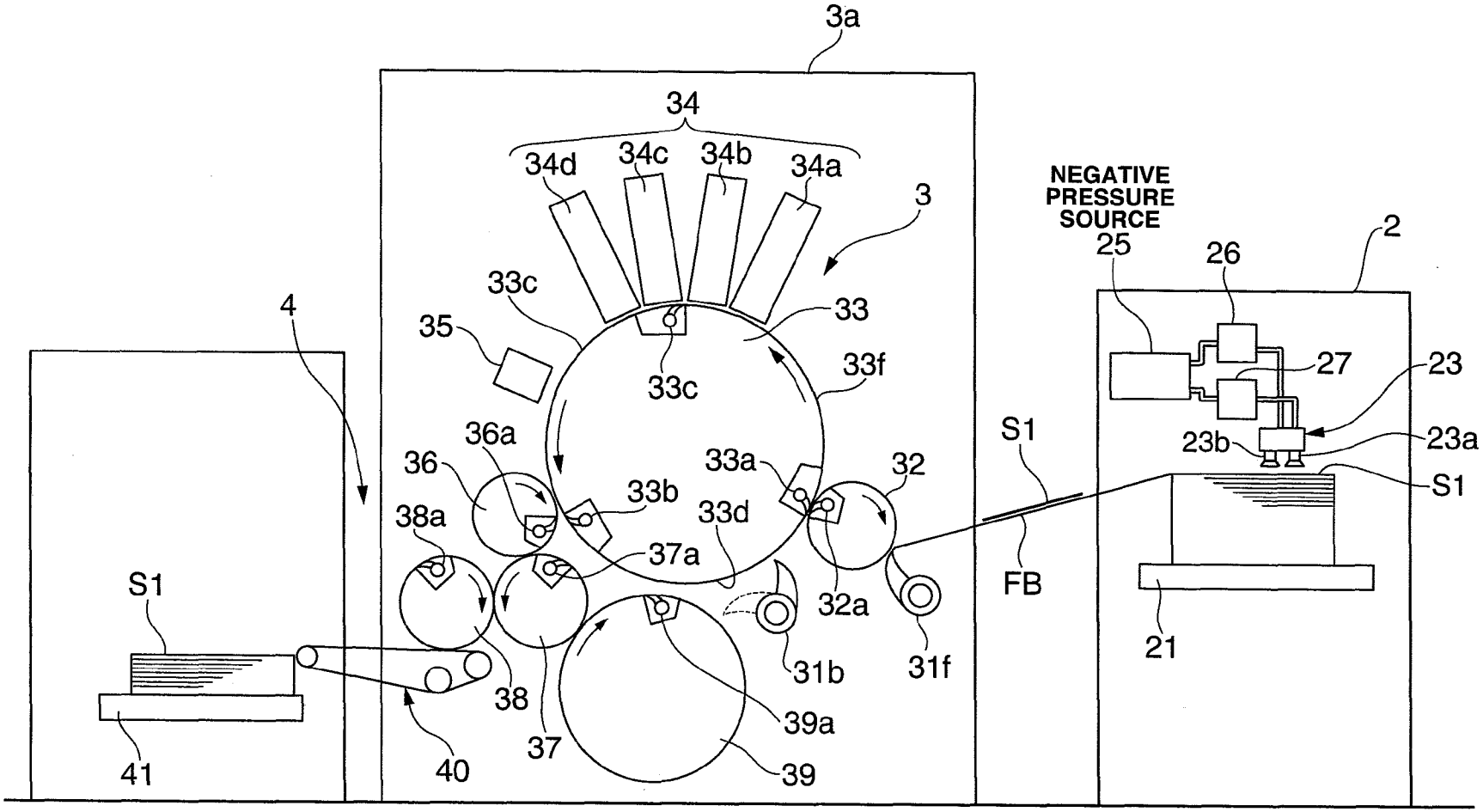
FIG. 1 is a side view showing the schematic arrangement of a digital printing apparatus according to the first embodiment of the present invention.

A digital printing apparatus 1 (sheet processing apparatus) according to this embodiment includes a sheet feed device 2 (sheet supply device), a digital printing unit 3 (processing unit), and a sheet delivery device 4 (sheet discharge device), as shown in FIG. 1.

The sheet feed device 2 includes a pile board 21 on which a plurality of sheets S1 are stacked, and a sucker device 23 which conveys the top sheet S1 on the pile board 21 onto a feeder board FB. The sucker device 23 includes a pair of suction ports 23*a* and 23*b*, which are connected to a negative pressure source 25 via a continuous supply valve 26 and an intermittent supply valve 27.

The continuous supply valve 26 and intermittent supply valve 27 enable/disable, at different timings, the suction operation of the suction ports 23*a* and 23*b* using a negative pressure from the negative pressure source 25.

A swing arm shaft pregripper 31*f* is disposed on the distal end side of the feeder board FB in the sheet conveyance direction. The swing arm shaft pregripper 31*f* is swingably supported on a frame 3*a* of the digital printing unit 3, and includes a gripper device (not shown) which grips and holds the leading edge (front edge) of the sheet S1 as its one edge. A feed-side transfer cylinder 32 is opposed to the swing arm shaft pregripper 31*f*, and rotatably supported on the frame 3*a*. A gripper device 32*a* which holds the leading edge of the sheet S1, transferred by a gripper device of the swing arm shaft pregripper 31*f*, in a gripped state is provided on the feed-side transfer cylinder 32. The swing arm shaft pregripper 31*f* and feed-side transfer cylinder 32 constitute an upstream sheet conveyance device. Note that in the following description, the gripper device is formed by a plurality of grippers aligned in the cylinder axis direction with predetermined gaps between them.

A printing cylinder 33 (second conveyance unit) serving as a downstream transport cylinder is disposed on the downstream side of the swing arm shaft pregripper 31*f* in the sheet conveyance direction to be in contact with the feed-side transfer cylinder 32. The printing cylinder 33 is rotatably supported on the frame 3*a*, and has a diameter three times that of the feed-side transfer cylinder 32. The printing cylinder 33 includes printing cylinder gripper devices 33*a*, 33*b*, and 33*c* (second holders) which hold the leading edge of the sheet S1 upon receiving it from the gripper device 32*a* of the feed-side transfer cylinder 32, and support surfaces 33*d*, 33*e*, and 33*f* which are provided in correspondence with the printing cylinder gripper devices 33*a*, 33*b*, and 33*c*, and support the sheet S1. The printing cylinder 33 is implemented by a triple-diameter cylinder provided with three pairs of printing cylinder gripper devices 33*a*, 33*b*, and 33*c* and support surfaces 33*d*, 33*e*, and 33*f*. The printing cylinder gripper devices 33*a*, 33*b*, and 33*c* are provided at positions 120° out of phase with each other in the circumferential direction.

An inkjet nozzle portion 34 is opposed to the circumferential surface of the printing cylinder 33 on the downstream side of the contact portion of the printing cylinder 33 with the feed-side transfer cylinder 32 in the sheet conveyance direction.

The inkjet nozzle portion 34 includes a plurality of inkjet nozzle heads 34*a* to 34*d* (to be referred to as ink heads hereinafter) which are juxtaposed in the sheet conveyance direction along the circumferential surface of the printing cylinder 33, and store inks of different colors. Each of the ink heads 34*a* to 34*d* is oriented in a direction perpendicular to the circumferential surface of the printing cylinder 33. The ink heads 34*a* to 34*d* are arranged in proximity to the printing cylinder 33 to have small gaps with the sheet S1 having its entire surface sucked by the support surfaces 33*d*, 33*e*, and 33*f*. The printing cylinder 33 and inkjet nozzle portion 34 constitute a sheet printing device.

An ink drying lamp 35 is opposed to the printing cylinder 33 on the downstream side of a printing region 33K, printed by the inkjet nozzle portion 34 of the printing cylinder 33, in the sheet conveyance direction, and serves as a drying device which irradiates the sheet S1 with light such as infrared or ultraviolet rays to dry ink printed on the sheet S1. Note that drying includes applying thermal energy to the ink to evaporate the moisture of the ink, and curing the ink.

The printing cylinder 33 is arranged on the downstream side of the inkjet nozzle portion 34 in the sheet conveyance direction to be in contact with a delivery-side transfer cylinder 36 rotatably supported on the frame 3*a*. The delivery-side transfer cylinder 36 has a gripper device 36*a* which holds the leading edge of the sheet S1, conveyed by the printing cylinder 33, upon receiving it from the printing cylinder gripper devices 33*a*, 33*b*, and 33*c*.

A delivery-side transfer cylinder 37 (fourth conveyance unit) serving as an upstream transport cylinder is arranged on the downstream side of the contact portion of the delivery-side transfer cylinder 36 with the printing cylinder 33 in the sheet conveyance direction to be in contact with the delivery-side transfer cylinder 36. The delivery-side transfer cylinder 37 is rotatably supported on the frame 3*a*. The delivery-side transfer cylinder 37 has a gripper device 37*a* (upstream gripper device) which receives and holds the leading edge of the sheet S1 conveyed by the delivery-side transfer cylinder 36.

A delivery cylinder 38 is arranged on the downstream side of the contact portion of the delivery-side transfer cylinder 37 with the delivery-side transfer cylinder 36 in the sheet conveyance direction to be in contact with the delivery-side transfer cylinder 37. The delivery cylinder 38 is rotatably supported on the frame 3*a*. The delivery cylinder 38 has a gripper device 38*a* (downstream gripper device) which receives and holds the leading edge of the sheet S1 conveyed by the delivery-side transfer cylinder 37.

A belt conveyor-shaped delivery belt 40 which conveys the sheet S1 is disposed below the delivery cylinder 38. A pile board 41 which stacks sheets S1 having undergone a digital printing process by the digital printing unit 3 is provided on the leading edge side of the delivery belt 40 in the sheet conveyance direction. The delivery cylinder 38, delivery belt 40, and pile board 41 constitute the sheet delivery device 4. Also, the path of the sheet S1 conveyed by the delivery cylinder 38 and delivery belt 40 constitutes a sheet discharge path.

A pre-reversal double-diameter cylinder 39 (first conveyance unit) serving as a transport cylinder is arranged on the downstream side of the contact portion of the delivery-side transfer cylinder 37 with the delivery cylinder 38 in the sheet conveyance direction to be in contact with the delivery-side transfer cylinder 37. The pre-reversal double-diameter cylinder 39 is rotatably supported on the frame 3*a*. The pre-reversal double-diameter cylinder 39 includes a gripper device 39*a* (first holder) which is implemented by a double-diameter cylinder with a diameter twice that of the delivery-side transfer cylinder 37, and receives and holds the leading edge of the sheet S1 conveyed by the delivery-side transfer cylinder 37. The pre-reversal double-diameter cylinder 39 also includes a circumferential surface 39*c* (support surface) which supports the entire surface of the sheet S1 with its leading edge held by the gripper device 39*a*.

Figure 2:
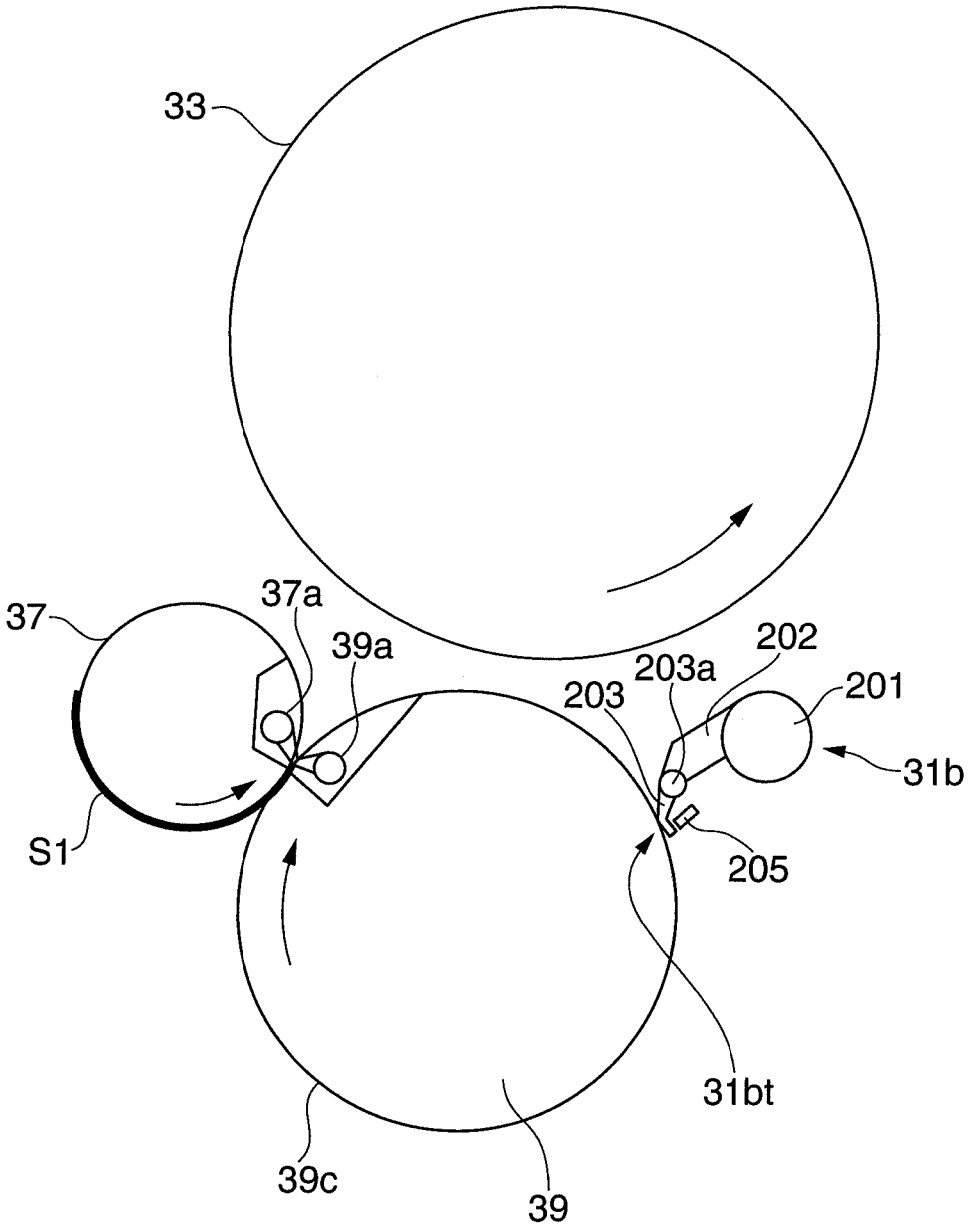
FIG. 2 is a side view showing a reversing mechanism portion shown in FIG. 1.

A reversing swing arm shaft pregripper 31*b* (third conveyance unit) having a reversing gripper device 31*bt* (third holder) which receives and holds the trailing edge (rear edge) of the sheet S1 as its other edge is opposed to the pre-reversal double-diameter cylinder 39 on the downstream side of the contact portion of the pre-reversal double-diameter cylinder 39 with the delivery-side transfer cylinder 37 in the sheet conveyance direction, as shown in FIG. 2.

A plurality of swing arms 202 are fixed to a reversing swing arm shaft 201 with predetermined gaps between them in the cylinder axis direction. The reversing swing arm shaft 201 is pivotally supported on the frame 3*a*. A swing arm gripper 203 is pivotally attached to the distal end of each of the plurality of swing arms 202 through a gripper shaft 203*a*.

A gripper pad 205 is provided at a position at which it is opposed to each swing arm gripper 203, and is attached to a gripper pad holding portion 204 fixed to the distal ends of the swing arms 202. A plurality of sets of swing arm grippers 203 and gripper pads 205 constitute the reversing gripper device 31*bt* which grips and holds the trailing edge of the sheet S1. The reversing gripper device 31*bt*, swing arms 202, reversing swing arm shaft 201, and gripper pad holding portion 204 constitute the reversing swing arm shaft pregripper 31*b*.

The reversing swing arm shaft pregripper 31*b* is supported to be swingable between a reception position (a broken line in FIG. 1), at which it receives the sheet S1 from the pre-reversal double-diameter cylinder 39, and a transfer position (a solid line in FIG. 1), at which it transfers by a gripping change the sheet S1 onto the printing cylinder 33, by pivoting the pivotal reversing swing arm shaft 201.

The reversing swing arm shaft pregripper 31*b* is opposed to the printing cylinder 33 on the downstream side of the contact portion of the printing cylinder 33 with the delivery-side transfer cylinder 36 in the rotation direction of the printing cylinder 33, and on the upstream side of the contact portion of the printing cylinder 33 with the feed-side transfer cylinder 32 in the rotation direction of the printing cylinder 33.

Figure 3:
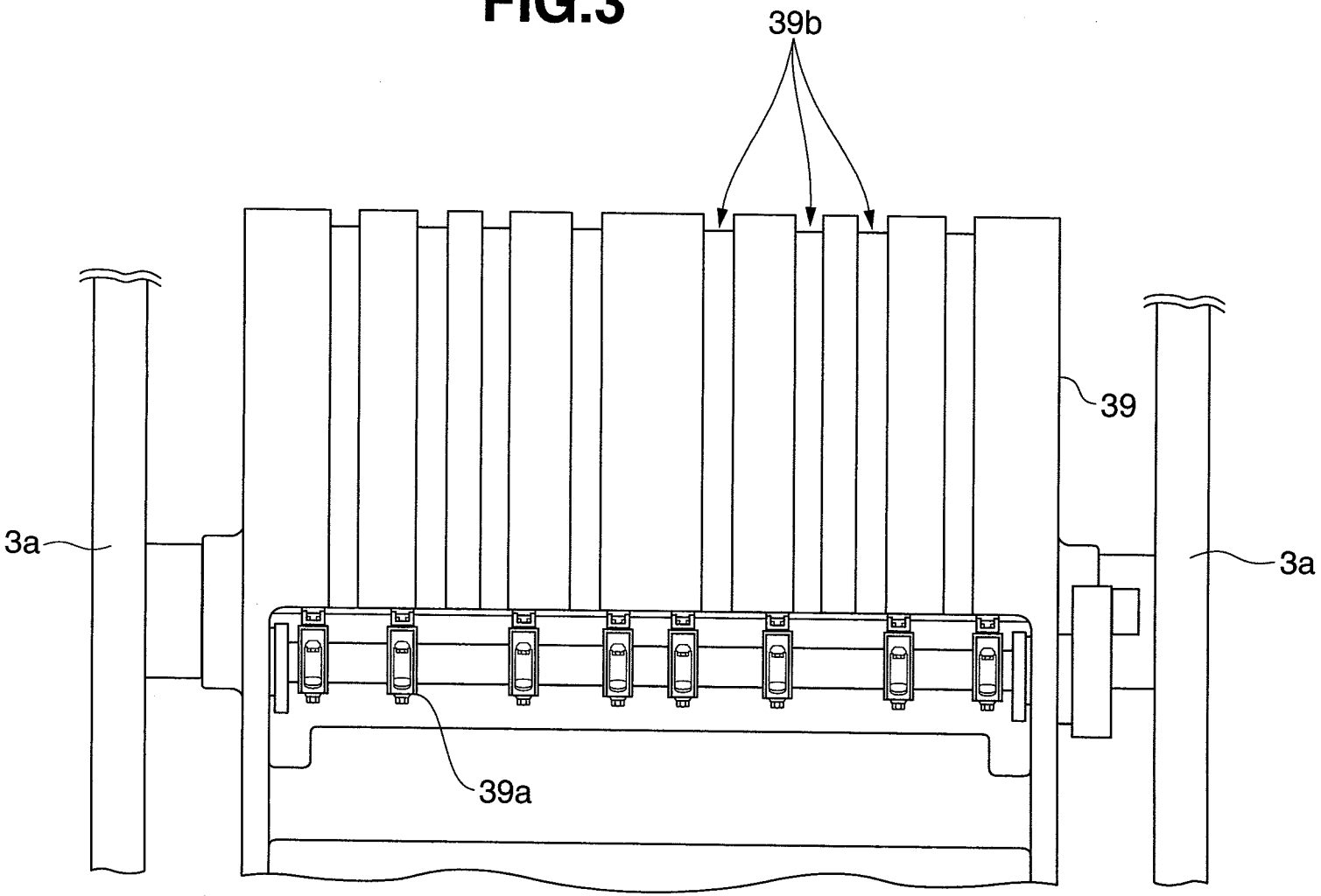
FIG. 3 is a top view showing the circumferential surface structure of a pre-reversal double-diameter cylinder shown in FIG. 2.

A plurality of groove-shaped recessed portions 39*b* are formed in the circumferential surface 39*c* of the pre-reversal double-diameter cylinder 39, pivotally supported on the frame 3*a*, with gaps between them in the axial direction to extend circumferentially, as shown in FIG. 3. The recessed portions 39*b* are opposed to the gripper device 37*a* of the delivery-side transfer cylinder 37, and the reversing gripper device 31*bt* of the reversing swing arm shaft pregripper 31*b*. The pre-reversal double-diameter cylinder 39 has a driving system independent of those of, for example, the printing cylinder 33, delivery-side transfer cylinder 37, and reversing swing arm shaft pregripper 31*b*, and is driven independently of the remaining cylinders by an independent driving motor 254 which independently drives it. Note that the pre-reversal double-diameter cylinder 39, reversing swing arm shaft pregripper 31*b*, and printing cylinder 33 constitute the sheet conveyance device.

The operation of the gripper device 37*a* of the delivery-side transfer cylinder 37 is controlled so as to selectively transfer the sheet S1 to the gripper device 38*a* of the delivery cylinder 38, and the gripper device 39*a* of the pre-reversal double-diameter cylinder 39. Also, the operation of the gripper device 38*a* of the delivery cylinder 38 is controlled so as to selectively receive the leading edge of the sheet S1 conveyed by the delivery-side transfer cylinder 37.

The delivery-side transfer cylinders 36 and 37, pre-reversal double-diameter cylinder 39, and reversing swing arm shaft pregripper 31*b* constitute a sheet reversing path used to turn and convey the sheet S1. The sheet reversing path is used to receive the sheet S1 from the printing cylinder 33, and turn and transfer the sheet S1 onto the printing cylinder 33.

The gripper device 37*a* of the delivery-side transfer cylinder 37, and the gripper device 38*a* of the delivery cylinder 38 constitute a sheet conveyance path switching device which selectively switches the path of the sheet S1 between the sheet reversing path and the sheet discharge path.

<Configuration of Control System for Digital Printing Apparatus>

Figure 4:
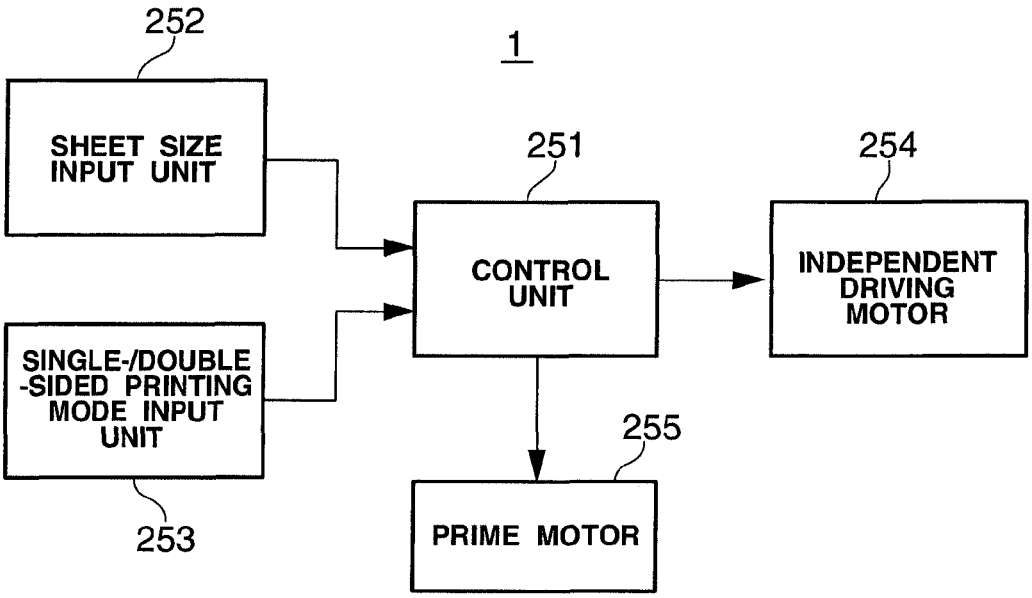
FIG. 4 is a control block diagram of the digital printing apparatus shown in FIG. 1.

The digital printing apparatus 1 includes a control unit 251 having a CPU (Central Processing Unit) configuration which controls the overall printing operation, as shown in FIG. 4. The control unit 251 is connected to a sheet size input unit 252 which receives the size of the sheet S1, a single-/double-sided printing mode input unit 253 (printing condition input unit) which selects a single- or double-sided printing mode, the independent driving motor 254 (independent driving unit) which independently drives the pre-reversal double-diameter cylinder 39, and a prime motor 255 (device driving unit) which drives the entire printing press. The prime motor 255 interlocks and drives the driving system for the printing press other than the pre-reversal double-diameter cylinder 39.

<Printing Operation of Digital Printing Apparatus>

The printing operation of the digital printing apparatus 1 configured as mentioned above will be described separately for the case wherein the single-sided printing mode is selected and that wherein the double-sided printing mode is selected.

When the single-sided printing mode is selected by operating a printing mode selection switch 80 by the operator, the continuous supply valve 26 is actuated. With this operation, the suction ports 23*a* and 23*b* suck the sheet S1 on the pile board 21, and convey it onto the feeder board FB, as shown in FIG. 1. When the single-sided printing mode is selected, the independent driving motor is controlled by the control unit 251 to stop the rotation of the pre-reversal double-diameter cylinder 39. This suppresses wasteful power consumption to allow energy saving.

The continuous supply valve 26 opens every time the same number of sheets S1 as the numbers of printing cylinder gripper devices 33*a*, 33*b*, and 33*c* of the printing cylinder 33 are supplied during 360° rotation of the printing cylinder 33, that is, at each timing (period) at which the printing cylinder gripper devices 33*a*, 33*b*, and 33*c* in the printing cylinder 33, and the gripper device 32*a* of the feed-side transfer cylinder 32 are opposed to each other. As the continuous supply valve 26 opens, a negative pressure is supplied from the negative pressure source 25 to the suction ports 23*a* and 23*b* to perform suction. Supply of the sheets S1 so that all the printing cylinder gripper devices 33*a*, 33*b*, and 33*c* of the printing cylinder 33 grip the sheets S1 will be referred to as continuous sheet feed hereinafter. Also, the period at which the continuous supply valve 26 opens/closes in continuous sheet feed will be referred to as a first period hereinafter. With this operation, the sucker device 23 conveys the sheets S1 onto the feeder board FB at the first period.

The leading edge of the sheet S1 conveyed by the feeder board FB is held by the gripper device of the swing arm shaft pregripper 31*f*, and the sheet S1 is conveyed onto the feed-side transfer cylinder 32 upon a swing of the swing arm shaft pregripper 31*f*. The leading edge of the sheet S1 conveyed onto the feed-side transfer cylinder 32 is transferred by a gripping change to the gripper device 32*a* of the feed-side transfer cylinder 32.

The leading edge of the sheet S1 conveyed with rotation of the feed-side transfer cylinder 32 is transferred by a gripping change from the gripper device 32*a* of the feed-side transfer cylinder 32 to one of the printing cylinder gripper devices 33*a*, 33*b*, and 33*c* of the printing cylinder 33, and the sheet S1 is conveyed with rotation of the printing cylinder 33. In the printing cylinder 33, a suction force acts on suction holes 33*g* on the downstream side in the rotation direction from a suction start position 33*i*, so the entire surface of the sheet S1 is sucked to and brought into tight contact with the support surfaces 33*d*, 33*e*, and 33*f* as the sheet S1 passes through the suction start position 33*i*.

A digital printing process is performed on the obverse surface of the sheet S1 conveyed by the printing cylinder 33 by discharging minute drops of ink from the ink heads 34*a* to 34*d* of the inkjet nozzle portion 34. The sheet S1 is in tight contact with the support surface of the printing cylinder 33, and is therefore conveyed while minute intervals with the ink heads 34*a* to 34*d* are maintained. Ink discharged while these minute intervals are maintained can be adhered to the sheet S1 with high accuracy, thereby allowing high-quality printing.

The ink on the sheet S1 printed by the inkjet nozzle portion 34 dries with light emitted by the ink drying lamp 35 when the sheet S1 passes between the printing cylinder 33 and the ink drying lamp 35. The sheet S1 is then conveyed onto the delivery-side transfer cylinder 36.

Figure 5A:
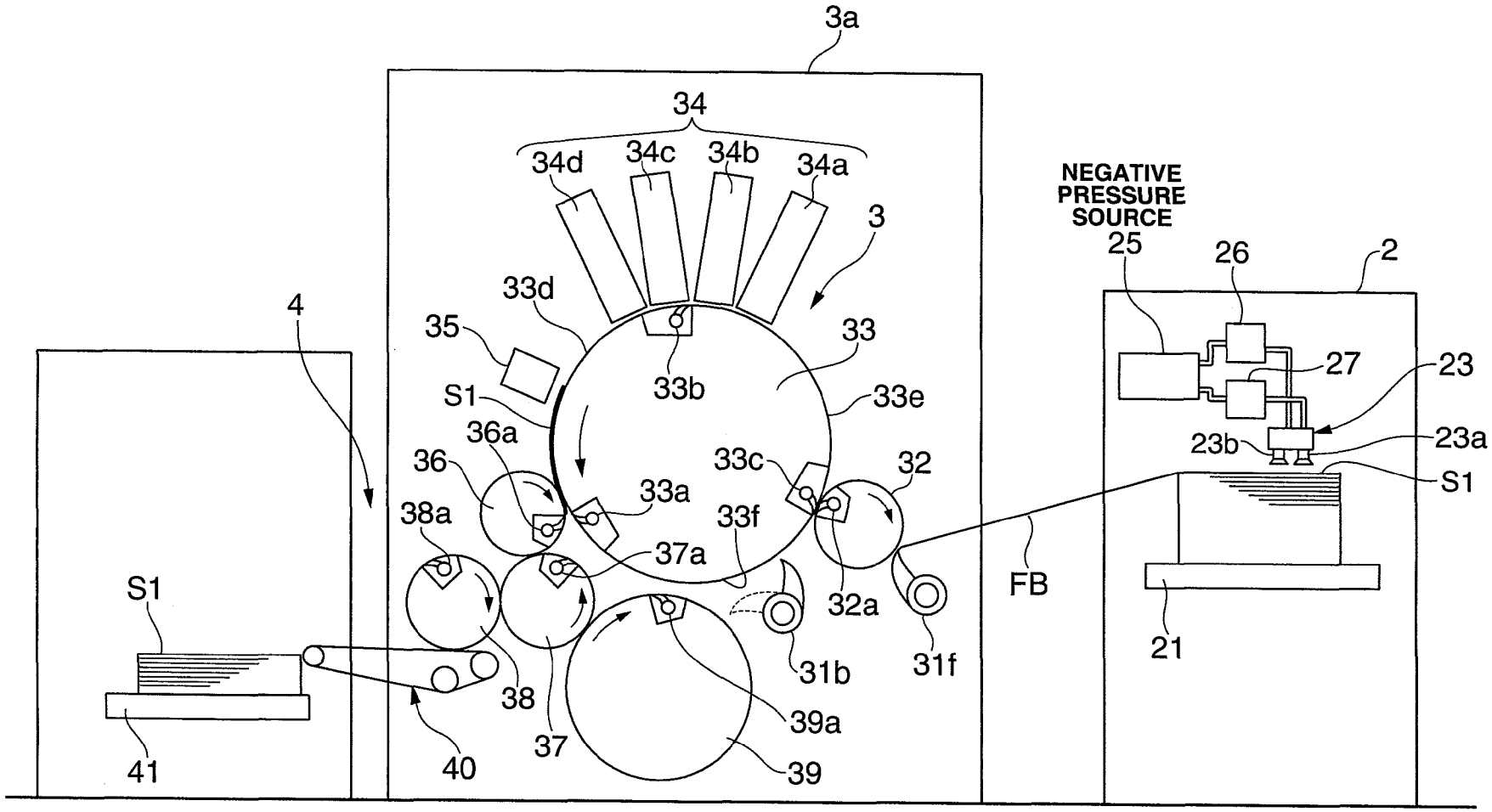
FIGS. 5A to 5E are side views showing double-sided printing processes (1) to (5) in the digital printing apparatus shown in FIG. 1.
Figure 5B:
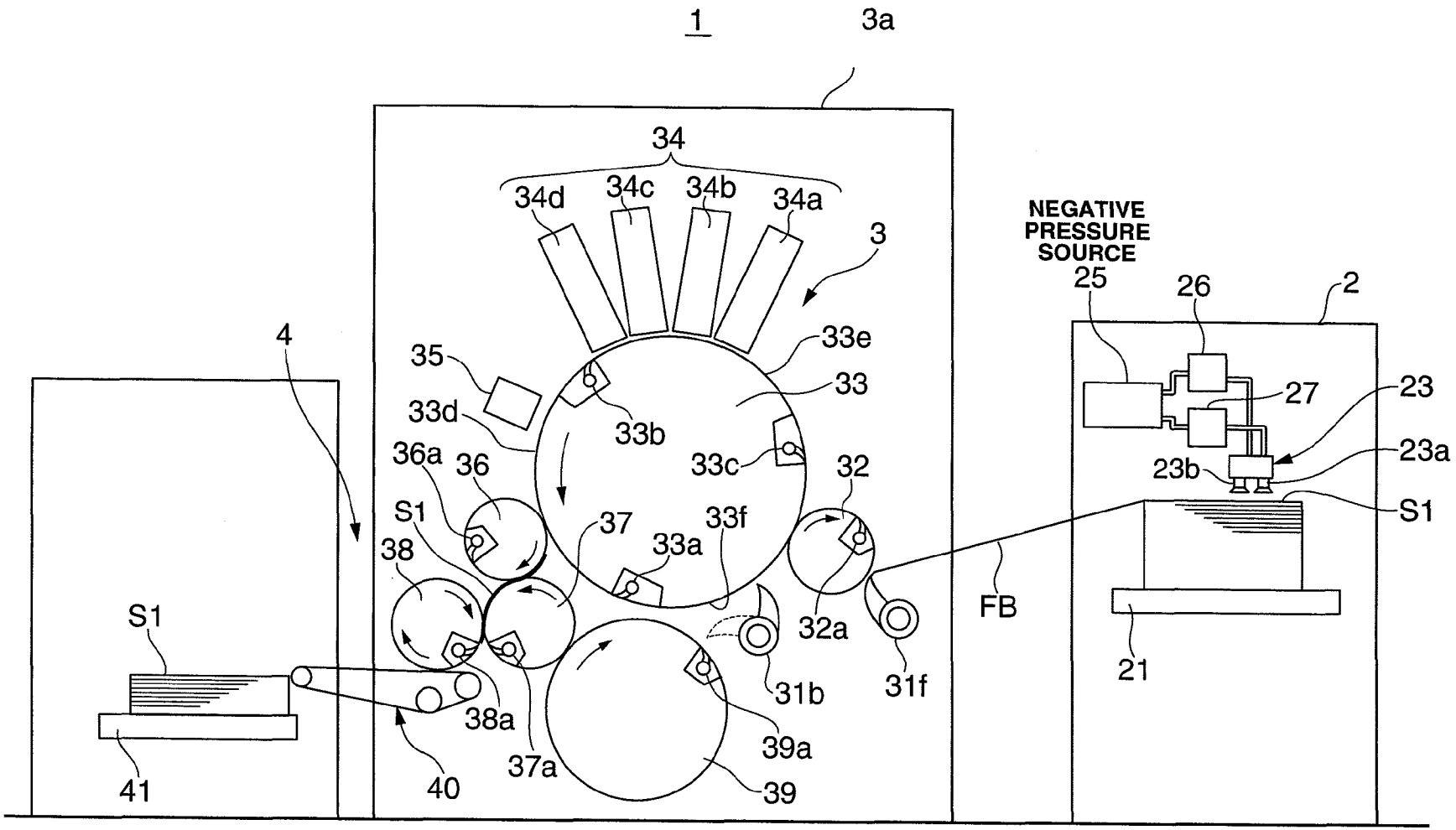

In the contact portion between the printing cylinder 33 and the delivery-side transfer cylinder 36, the leading edge of the sheet S1 is transferred by a gripping change from the printing cylinder gripper devices 33*a* to 33*c* of the printing cylinder 33 to the gripper device 36*a* of the delivery-side transfer cylinder 36, as shown in FIG. 5A. At this time, the leading edge of the sheet S1 passes through a suction end position 33*j*, so no suction force acts from the suction holes 33*g*. This makes it possible to easily peel the sheet S1 off the support surfaces 33*d*, 33*e*, and 33*f* to allow a smooth gripping change. Then, the leading edge of the sheet S1 held by the gripper device 36*a* of the delivery-side transfer cylinder 36 is transferred by a gripping change from the gripper device 36*a* of the delivery-side transfer cylinder 36 to the gripper device 37*a* of the delivery-side transfer cylinder 37 in the contact portion between the delivery-side transfer cylinders 36 and 37, as shown in FIG. 5B.

In the single-sided printing mode, in the phase in which the leading edge of the sheet S1 is positioned in the contact portion between the delivery-side transfer cylinders 37 and 38, the gripper device 37*a* of the delivery-side transfer cylinder 37 cancels holding of the leading edge of the sheet S1, and the gripper device 38*a* of the delivery cylinder 38 grips and holds the leading edge of the sheet S1 at the same time. With this operation, the sheet S1 printed on its one surface is transferred from the delivery-side transfer cylinder 37 onto the delivery cylinder 38, and conveyed.

Holding, by the gripper device 38*a*, of the sheet S1 transferred onto the delivery cylinder 38 is canceled at the timing at which the gripper device 38*a* of the delivery cylinder 38 is positioned above the delivery belt 40, and is placed on the delivery belt 40.

The sheet S1 placed on the delivery belt 40 is conveyed as the delivery belt 40 travels, and the sheet S1 having undergone a digital printing process on its obverse surface is discharged onto the pile board 41 of the sheet delivery device 4.

In the single-sided printing mode, all sheets S1 are switched to the sheet discharge path, so no sheet S1 is conveyed to either the pre-reversal double-diameter cylinder 39 or reversing swing arm shaft pregripper 31*b*. Further, in the single-sided printing mode, the pre-reversal double-diameter cylinder 39 is kept stopped without rotation, and the delivery-side transfer cylinder 37 and reversing swing arm shaft pregripper 31*b* provided on the upstream and downstream sides of the pre-reversal double-diameter cylinder 39 operate, but the recessed portions 39*b* in the pre-reversal double-diameter cylinder 39 are opposed to the gripper device 37*a* of the delivery-side transfer cylinder 37, and the reversing gripper device 31*bt* of the reversing swing arm shaft pregripper 31*b*, so the gripper devices 37*a* and 31*bt* do not interfere with the pre-reversal double-diameter cylinder 39.

On the other hand, when the double-sided printing mode is selected by an operation input to the single-/double-sided printing mode input unit 253, the operator inputs the dimension of the sheet S1 in the conveyance direction to the sheet size input unit 252. When a printing operation starts, the control unit 251 actuates the intermittent supply valve 27 to make the suction ports 23*a* and 23*b* suck and convey the sheet S1 on the pile board 21 onto the feeder board FB.

The intermittent supply valve 27 is controlled at the timing at which the sheets S1 are alternately supplied so as to open, close, open, close, . . . , at the timing of continuous supply, that is, the timing at which the printing cylinder gripper devices 33*a*, 33*b*, and 33*c* of the printing cylinder 33, and the gripper device 32*a* of the feed-side transfer cylinder 32 are opposed to each other. This period is twice that of continuous supply. In this manner, supply of the sheets S1 so that the printing cylinder gripper devices 33*a*, 33*b*, and 33*c* of the printing cylinder 33 alternately grip the sheets S1 will be referred to as intermittent sheet feed hereinafter, and the period at which the intermittent supply valve 27 opens/closes in intermittent sheet feed will be referred to as a second period hereinafter.

With this operation, the sucker device 23 conveys the sheets S1 onto the feeder board FB at the second period.

The sheet S1 fed onto the feeder board FB by the sucker device 23 is transferred onto the printing cylinder 33 through the swing arm shaft pregripper 31*f* and feed-side transfer cylinder 32 in the same way as in the single-sided printing mode. At this time, since the sheet S1 is fed at the timing of intermittent sheet feed, the printing cylinder gripper devices 33*a* to 33*c* of the printing cylinder 33 receive the sheet S1 alternately conveyed from the feed-side transfer cylinder 32.

The sheet S1 transferred onto the printing cylinder 33 is conveyed to the inkjet nozzle portion 34, and obverse surface printing is performed on one surface (obverse surface). The control unit 251 prints on the sheet S1 alternately held by the printing cylinder gripper devices 33*a* to 33*c* of the printing cylinder 33, based on a phase signal from the rotary encoder 84. On the other hand, the ink heads 34*a* to 34*d* of the inkjet nozzle portion 34 are controlled so as not to print on the support surfaces 33*d* to 33*f* corresponding to the printing cylinder gripper devices 33*a* to 33*c* which do not hold the sheet S1.

For double-sided printing, the control unit 251 controls the conveyance path switching device 82 so that the sheet S1 printed on its obverse surface by the inkjet nozzle portion 34 is transferred onto the pre-reversal double-diameter cylinder 39 without transferring it from the delivery-side transfer cylinder 37 onto the delivery cylinder 38.

More specifically, in conveyance path switching control, in the phase in which the sheet S1 which is printed on its obverse surface and has undergone no digital print process on its other surface (reverse surface) is positioned in the contact portion between the delivery-side transfer cylinder 37 and the delivery cylinder 38, the grippers of the gripper device 37*a* of the delivery-side transfer cylinder 37 are kept closed without opening to maintain the state in which the gripper device 37*a* holds the leading edge of the sheet S1. At this time, the grippers of the gripper device 38*a* of the delivery cylinder 38 are kept open without closing. With this operation, the sheet S1 printed only on its obverse surface continues to be conveyed by the delivery-side transfer cylinder 37 without a gripping change from the delivery-side transfer cylinder 37 to the delivery cylinder 38.

Figure 5C:
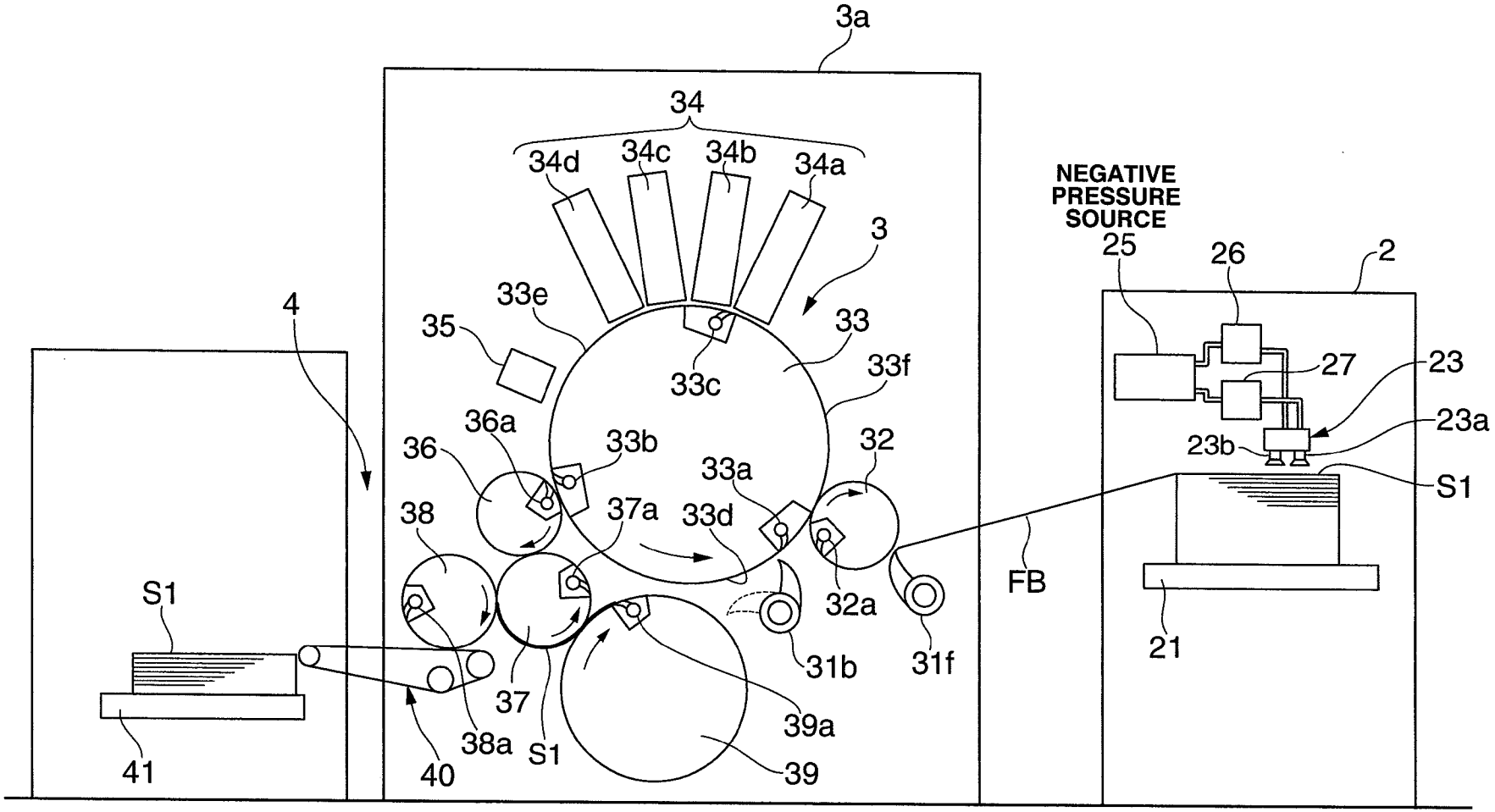

The leading edge of the sheet S1 conveyed by the delivery-side transfer cylinder 37 is held by closing the grippers of the gripper device 39*a* of the pre-reversal double-diameter cylinder 39 in the contact portion between the delivery-side transfer cylinder 37 and the pre-reversal double-diameter cylinder 39. At the same time, holding of the leading edge of the sheet S1 is canceled by opening the grippers of the gripper device 37*a* of the delivery-side transfer cylinder 37. With this operation, the leading edge of the sheet S1 is transferred by a gripping change from the gripper device 37*a* of the delivery-side transfer cylinder 37 to the gripper device 39*a* of the pre-reversal double-diameter cylinder 39, as shown in FIG. 5C.

At this time, since the groove-shaped recessed portions 39*b* (FIG. 3) are formed in the circumferential surface 39*c* of the pre-reversal double-diameter cylinder 39 to be opposed to the gripper device 37*a* of the delivery-side transfer cylinder 37, the gripper device 37*a* of the delivery-side transfer cylinder 37 passes through the grooves of the recessed portions 39*b* to prevent the circumferential surface of the pre-reversal double-diameter cylinder 39 from suffering damage.

Figure 5D:
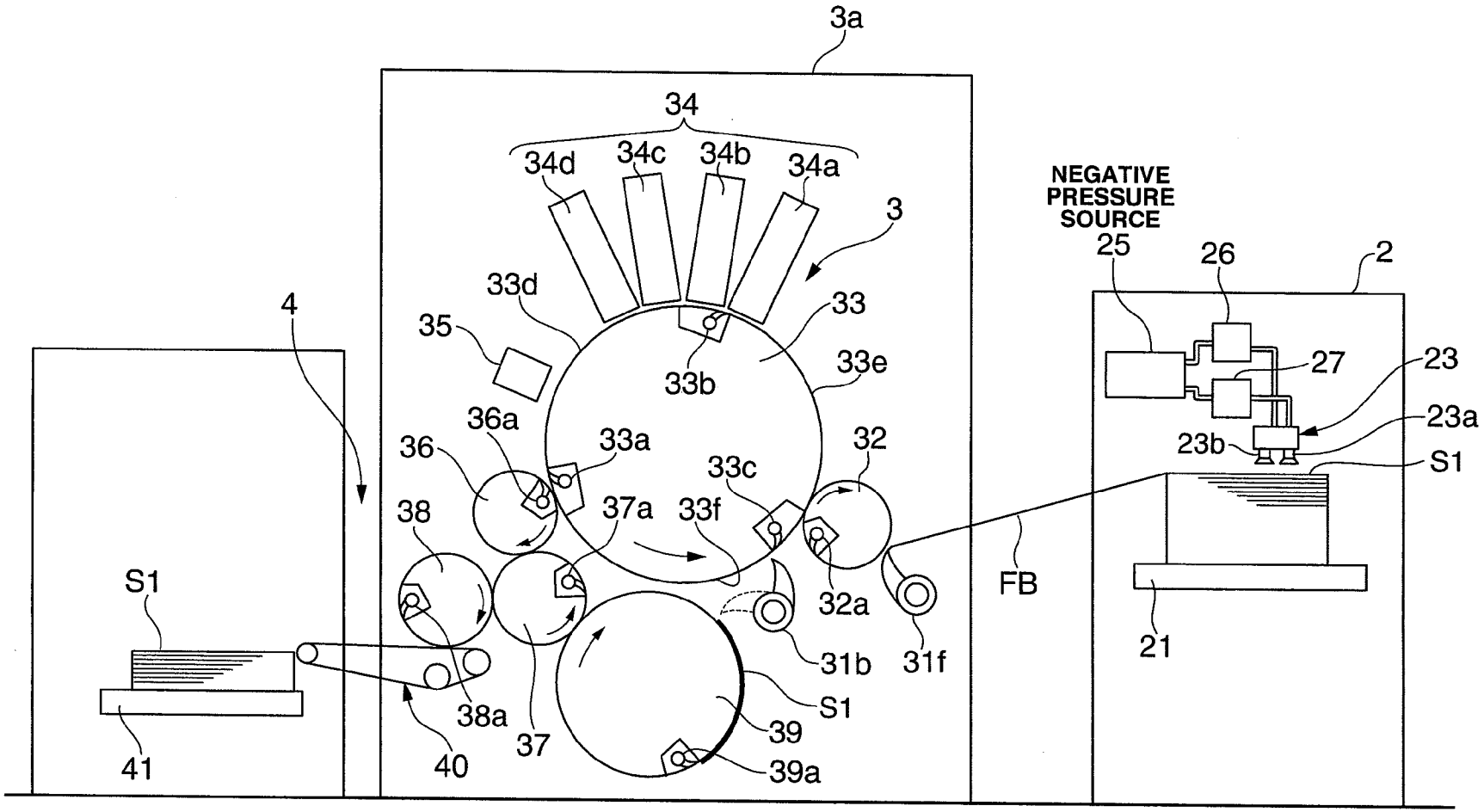

The sheet S1 conveyed with rotation of the pre-reversal double-diameter cylinder 39 is conveyed with rotation of the pre-reversal double-diameter cylinder 39, as shown in FIG. 5D. The reversing swing arm shaft pregripper 31*b* swings from a transfer position (solid line) to a reception position (broken line) to make the reversing gripper device 31*bt* of the reversing swing arm shaft pregripper 31*b* hold the trailing edge of the sheet S1, and holding of the leading edge of the sheet S1 by the gripper device 39*a* of the pre-reversal double-diameter cylinder 39 is canceled at the same time. With this operation, the sheet S1 is transferred by a gripping change from the pre-reversal double-diameter cylinder 39 to the reversing swing arm shaft pregripper 31*b*.

At this time, since the groove-shaped recessed portions 39*b* (FIG. 3) are formed in the circumferential surface of the pre-reversal double-diameter cylinder 39 to be opposed to the reversing gripper device 31*bt* of the reversing swing arm shaft pregripper 31*b*, the reversing gripper device 31*bt* of the reversing swing arm shaft pregripper 31*b* passes through the grooves of the recessed portions 39*b* to prevent the circumferential surface of the pre-reversal double-diameter cylinder 39 from suffering damage.

An operation in which the pre-reversal double-diameter cylinder 39 receives the sheet S1 from the delivery-side transfer cylinder 37, and transfers it to the reversing swing arm shaft pregripper 31*b* (driving control of the pre-reversal double-diameter cylinder 39) will be described in detail. If the dimension in the conveyance direction, which is input to the sheet size input unit 252, is a standard size (middle-sized paper), the control unit 251 controls the independent driving motor 254 to rotate the pre-reversal double-diameter cylinder 39 at a reference speed. The reference speed means the rotation speed at which the pre-reversal double-diameter cylinder 39 rotates at a peripheral speed equal to those of the printing cylinder 33 and delivery-side transfer cylinder 37. The pre-reversal double-diameter cylinder 39 rotates at the reference speed with no difference in peripheral speed between the printing cylinder 33 and the delivery-side transfer cylinder 37.

Figure 6:
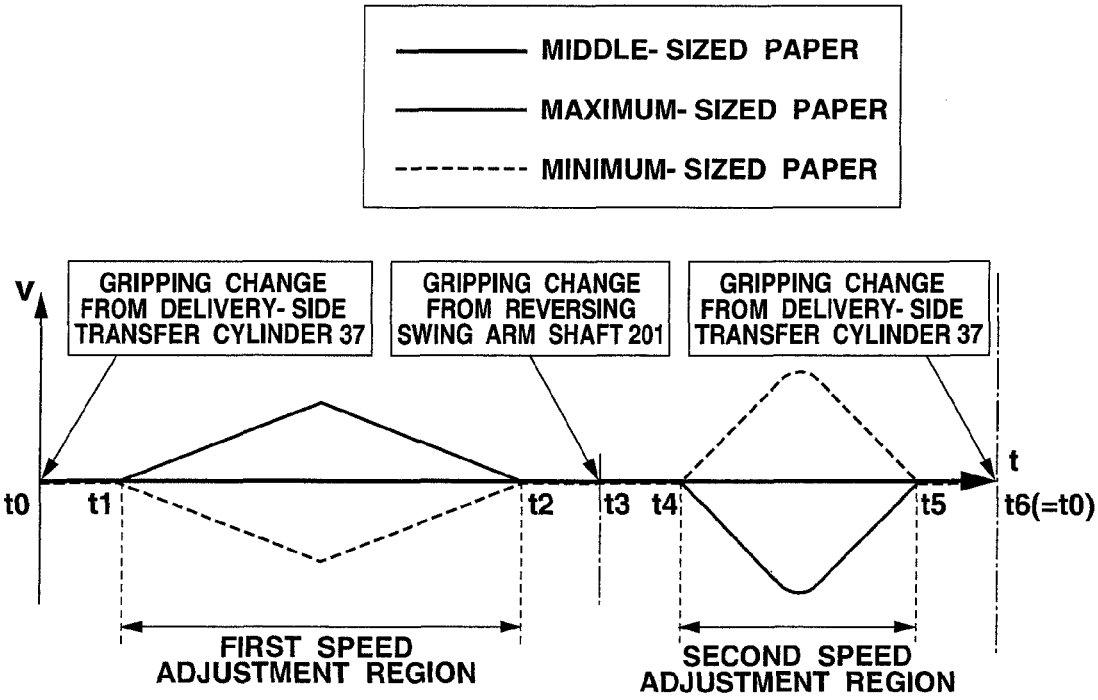
FIG. 6 is a timing chart showing the speed control sequence of the pre-reversal double-diameter cylinder shown in FIG. 2.

The control operation of the rotation speed of the pre-reversal double-diameter cylinder 39 by the control unit 251 will be described with reference to FIG. 6. FIG. 6 shows the rotation speed of the pre-reversal double-diameter cylinder 39 when the digital printing apparatus 1 operates at a steady speed, that is, the printing cylinder 33 and delivery-side transfer cylinder 37 rotate at a constant speed. FIG. 6 shows the time or the phase of the digital printing apparatus 1 on the abscissa, and the rotation speed of the pre-reversal double-diameter cylinder 39 on the ordinate. Note that t0 is the reception timing at which the leading edge of the sheet S1 is transferred by a gripping change from the delivery-side transfer cylinder 37 to the pre-reversal double-diameter cylinder 39, t1 is the first adjustment start timing of the rotation speed of the pre-reversal double-diameter cylinder 39, t2 is the first adjustment end timing of the rotation speed of the pre-reversal double-diameter cylinder 39, and t3 is the transfer timing at which the trailing edge of the sheet S1 is transferred by a gripping change from the pre-reversal double-diameter cylinder 39 to the reversing swing arm shaft pregripper 31*b*. Also, t4 is the second adjustment start timing of the rotation speed of the pre-reversal double-diameter cylinder 39, t5 is the second adjustment end timing of the rotation speed of the pre-reversal double-diameter cylinder 39, and t6 is the reception timing at which the leading edge of the sheet S1 is transferred by a gripping change from the delivery-side transfer cylinder 37 to the pre-reversal double-diameter cylinder 39 again.

Note that the above-mentioned timings t0 to t6 indicate the times or the phases of the digital printing apparatus 1, and reception timings t6 and t0 are identical when the timing is represented as a phase. Also, the interval from first adjustment start timing t1 to first adjustment end timing t2 is defined as a first speed adjustment region, and that from second adjustment start timing t4 to second adjustment end timing t5 is defined as a second speed adjustment region.

If the dimension of the sheet S1 in the conveyance direction is a standard size (middle-sized paper), when the digital printing apparatus 1 operates at a steady speed, the pre-reversal double-diameter cylinder 39 is rotated by the independent driving motor 254 at a constant speed v0 (reference speed) with no change in speed from reception timing t0 to reception timing t6, as indicated by bold lines in FIG. 6. The pre-reversal double-diameter cylinder 39 must be rotated at a peripheral speed equal to those of the printing cylinder 33 and delivery-side transfer cylinder 37. Hence, when the digital printing apparatus 1 operates at a steady speed, the printing cylinder 33 and delivery-side transfer cylinder 37 are driven by the prime motor 255, while the pre-reversal double-diameter cylinder 39 is rotated at a constant speed v0 by the independent driving motor 254. However, when the digital printing apparatus 1 does not operate at a steady speed, the pre-reversal double-diameter cylinder 39 is rotated by the independent driving motor 254 at a peripheral speed which is equal to those of the printing cylinder 33 and delivery-side transfer cylinder 37 and different from the reference speed.

Upon this operation, at reception timing t0, the gripper device 37*a* of the delivery-side transfer cylinder 37, and the gripper device 39*a* of the pre-reversal double-diameter cylinder 39 are opposed to each other, so the leading edge of a sheet S1 with the standard size is transferred by a gripping change, and the sheet S1 is wound around the circumferential surface 39*c* of the pre-reversal double-diameter cylinder 39 and conveyed, as shown in FIG. 2.

Figure 7:
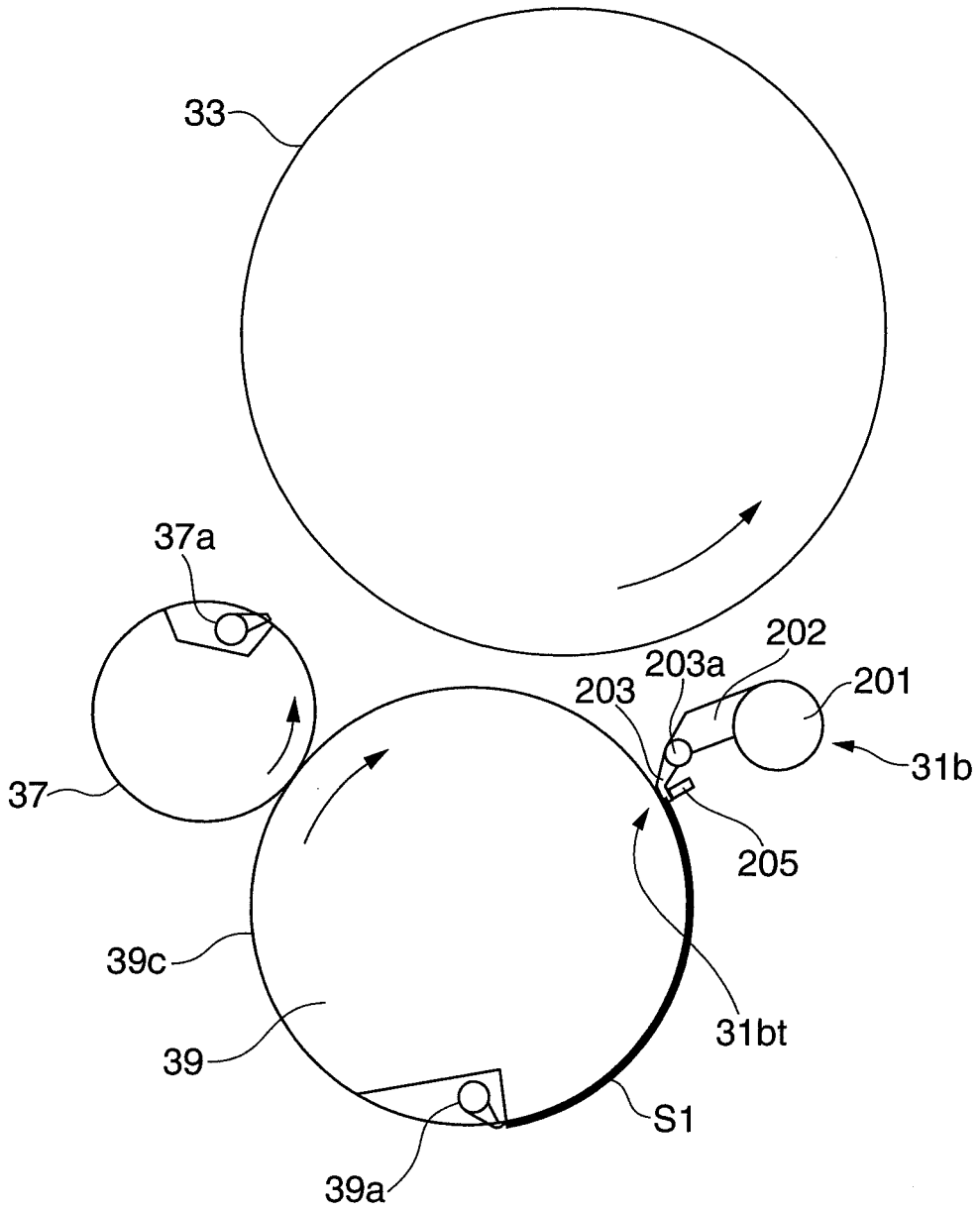
FIG. 7 is a side view for explaining a sheet gripping change operation from the pre-reversal double-diameter cylinder to a reversing swing arm shaft pregripper if the sheet size is a standard size.

At transfer timing t3, the trailing edge of the sheet S1 which has the standard size and is conveyed by the pre-reversal double-diameter cylinder 39 rotated at the constant speed v0 is opposed to the reversing gripper device 31*bt* of the reversing swing arm shaft pregripper 31*b* at a predetermined period at which the reversing swing arm shaft pregripper 31*b* is set at the reception position, as shown in FIG. 7.

As the reversing gripper device 31*bt* of the reversing swing arm shaft pregripper 31*b* grips the trailing edge of the sheet S1, and the gripper device 39*a* of the pre-reversal double-diameter cylinder 39 cancels holding of the leading edge of the sheet S1, the sheet S1 is transferred by a gripping change from the pre-reversal double-diameter cylinder 39 to the reversing swing arm shaft pregripper 31*b*. The reversing swing arm shaft pregripper 31*b* then swings from the reception position to the transfer position, and transfers the turned sheet S1 onto the printing cylinder 33, as shown in FIG. 8.

As described above, if the sheet S1 has the standard size, the control unit 251 controls the pre-reversal double-diameter cylinder 39 to simply rotate at the reference speed through the independent driving motor 254, so no change in speed with respect to the reference speed occurs.

Figure 8:
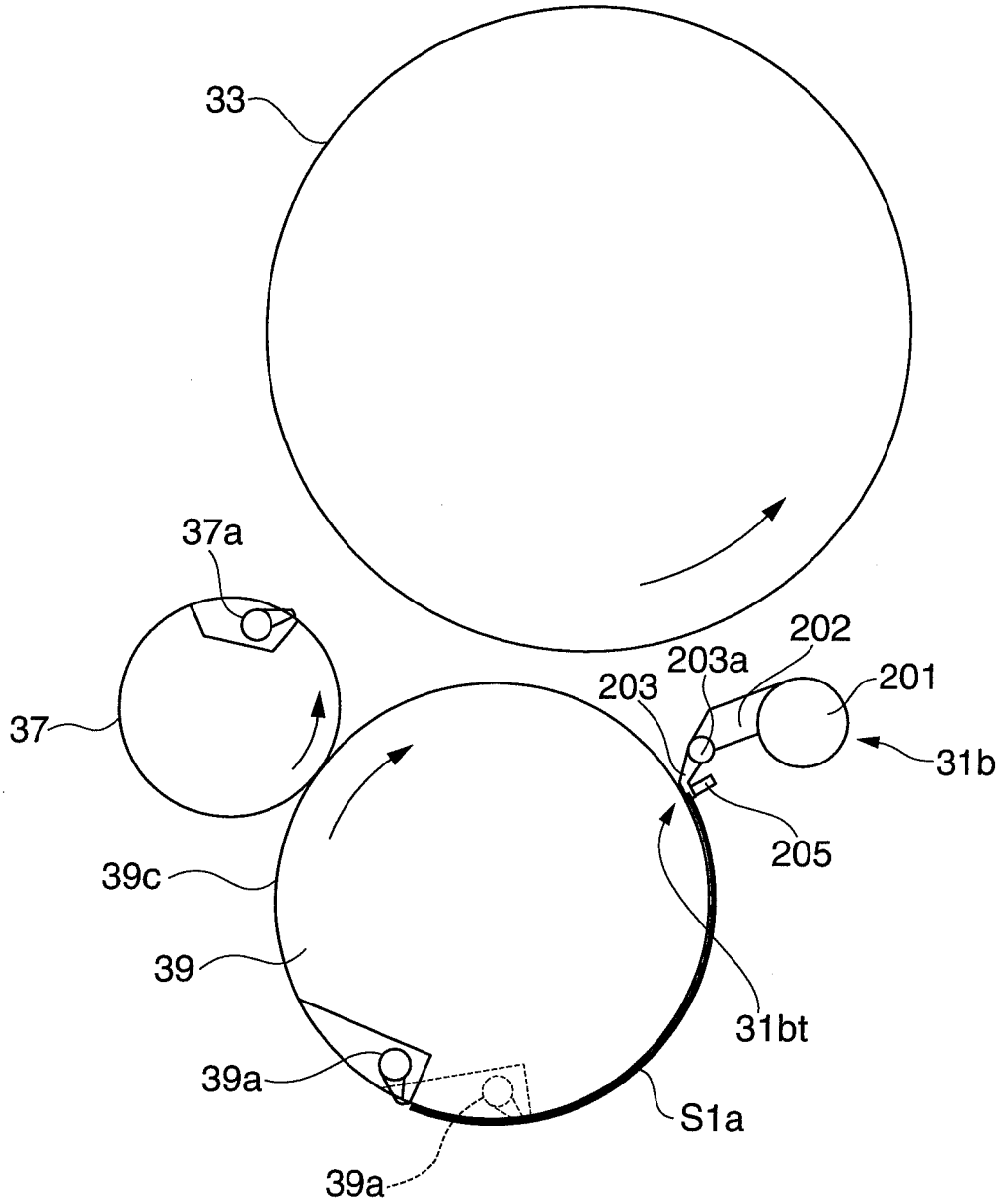
FIG. 8 is a side view for explaining a sheet gripping change operation from the pre-reversal double-diameter cylinder to the reversing swing arm shaft pregripper if the sheet size is larger than the standard size.

Control if the dimension of the sheet S1 in the conveyance direction is larger than the standard size, as shown in FIG. 8, will be described next. The case of a sheet S1*a* (maximum-sized paper) with a maximum dimension in the conveyance direction, that the digital printing apparatus 1 can print, will be explained. At reception timing t0, transfer timing t3, and reception timing t6, the control unit 251 rotates the pre-reversal double-diameter cylinder 39 at a reference speed (speed v0) equal to that in the case of the sheet S1 with the standard size (middle-sized paper), as indicated by solid lines in FIG. 6. On the other hand, in the first speed adjustment region, the speed of the pre-reversal double-diameter cylinder 39 is controlled to gradually increase with respect to the reference speed from first adjustment start timing t1, and return to the reference speed at first adjustment end timing t2. Then, in the second speed adjustment region, the speed of the pre-reversal double-diameter cylinder 39 is controlled to gradually decrease with respect to the reference speed from second adjustment start timing t4, and return to the reference speed at second adjustment end timing t5. Note that the control unit 251 rotates the pre-reversal double-diameter cylinder 39 at the reference speed (speed v0) in the interval from reception timing t0 to first adjustment start timing t1, that from first adjustment end timing t2 to second adjustment start timing t4, and that from second adjustment end timing t5 to reception timing t6.

In this case, at reception timing t0 and transfer timing t3, the pre-reversal double-diameter cylinder 39 receives the sheet S1*a* from the delivery-side transfer cylinder 37 and transfers it to the reversing swing arm shaft pregripper 31*b* while rotating at the reference speed. This allows a reliable gripping change of the sheet S1*a*.

Normally, when maximum-sized paper with a large size is transferred by a gripping change from the pre-reversal double-diameter cylinder 39 to the reversing swing arm shaft pregripper 31*b*, the gripper device 39*a* of the pre-reversal double-diameter cylinder 39 is set at a position, indicated by a broken line in FIG. 8, at transfer timing t3 as the pre-reversal double-diameter cylinder 39 rotates while its rotation speed is kept at the constant speed v0 (reference speed). In this case, the trailing edge of the sheet S1*a* has not yet reached the reversing gripper device 31*bt* of the reversing swing arm shaft pregripper 31*b* set at the reception position, and therefore cannot be gripped by the reversing gripper device 31*bt*.

However, in the arrangement of this embodiment, in the first speed adjustment region, the pre-reversal double-diameter cylinder 39 is accelerated from the reference speed to advance the phase of the pre-reversal double-diameter cylinder 39 more than that of the digital printing apparatus 1, thereby setting the gripper device 39*a* of the pre-reversal double-diameter cylinder 39 at a position, indicated by a solid line in FIG. 8, at transfer timing t3. Upon this operation, the trailing edge of the sheet S1*a* is opposed to the reversing gripper device 31*bt* of the reversing swing arm shaft pregripper 31*b* set at the reception position.

Figure 5E:
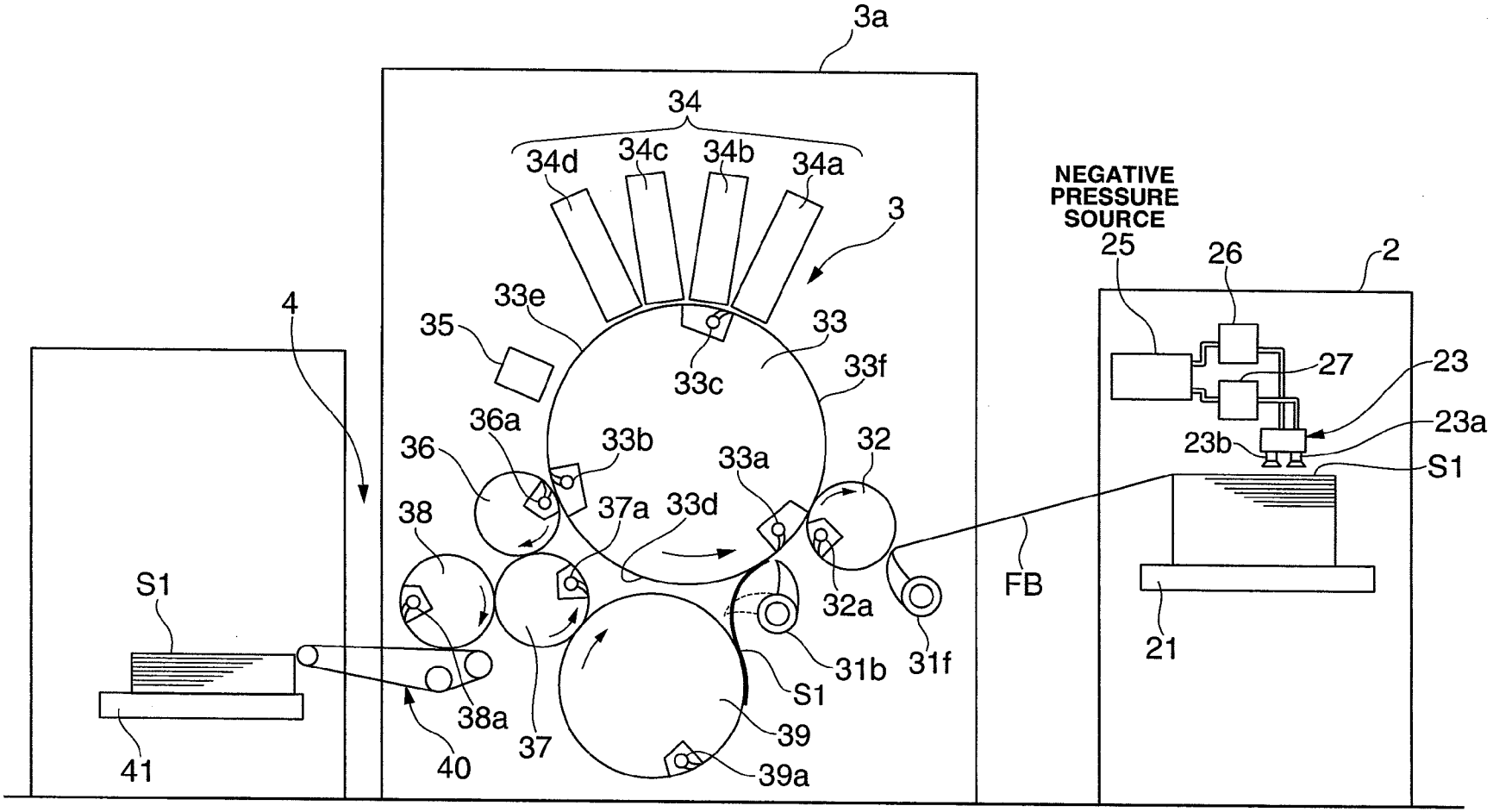

By controlling the speed of the pre-reversal double-diameter cylinder 39 in this way, the trailing edge of the sheet S1*a* is gripped by the reversing gripper device 31*bt* of the reversing swing arm shaft pregripper 31*b*, and holding of the leading edge of the sheet S1*a* is canceled by the gripper device 39*a* of the pre-reversal double-diameter cylinder 39 at the same time. With this operation, the sheet S1*a* is transferred by a gripping change from the pre-reversal double-diameter cylinder 39 to the reversing swing arm shaft pregripper 31*b*. The reversing swing arm shaft pregripper 31*b* then swings from the reception position to the transfer position, and transfers the turned sheet S1*a* onto the printing cylinder 33, as shown in FIG. 5E.

After the trailing edge of the sheet S1*a* (maximum-sized paper) is transferred by a gripping change from the pre-reversal double-diameter cylinder 39 to the reversing swing arm shaft pregripper 31*b* at transfer timing t3, the control unit 251 rotates the pre-reversal double-diameter cylinder 39 at the speed v0 (reference speed). Then, in the second speed adjustment region, the pre-reversal double-diameter cylinder 39 is decelerated from the reference speed to retard the phase of the pre-reversal double-diameter cylinder 39, which has advanced more than that of the digital printing apparatus 1. Upon such phase control, at reception timing t6, the gripper device 39*a* of the pre-reversal double-diameter cylinder 39 is opposed to the gripper device 37*a* of the delivery-side transfer cylinder 37, as shown in FIG. 2. With this operation, the leading edge of the sheet S1*a* is transferred by a gripping change from the gripper device 37*a* of the delivery-side transfer cylinder 37 to the gripper device 39*a* of the pre-reversal double-diameter cylinder 39.

With this arrangement, the control unit 251 increases/decreases the rotation speed of the pre-reversal double-diameter cylinder 39 to control (adjust) the phase of the pre-reversal double-diameter cylinder 39 relative to that of the digital printing apparatus 1 in the first and second speed adjustment regions, that do not influence reception timing t0, transfer timing t3, and reception timing t6 at which a gripping change of the sheet S1*a* (maximum-sized paper) is done.

As described above, even if a sheet S1*a* with a dimension in the conveyance direction, which is larger than the standard size, is used, the leading edge of the sheet S1*a* can reliably be transferred by a gripping change from the delivery-side transfer cylinder 37 to the pre-reversal double-diameter cylinder 39 by increasing/decreasing the rotation speed of the pre-reversal double-diameter cylinder 39. Also, the trailing edge of the sheet S1*a* can reliably be transferred by a gripping change from the pre-reversal double-diameter cylinder 39 to the reversing swing arm shaft pregripper 31*b*.

Figure 9:
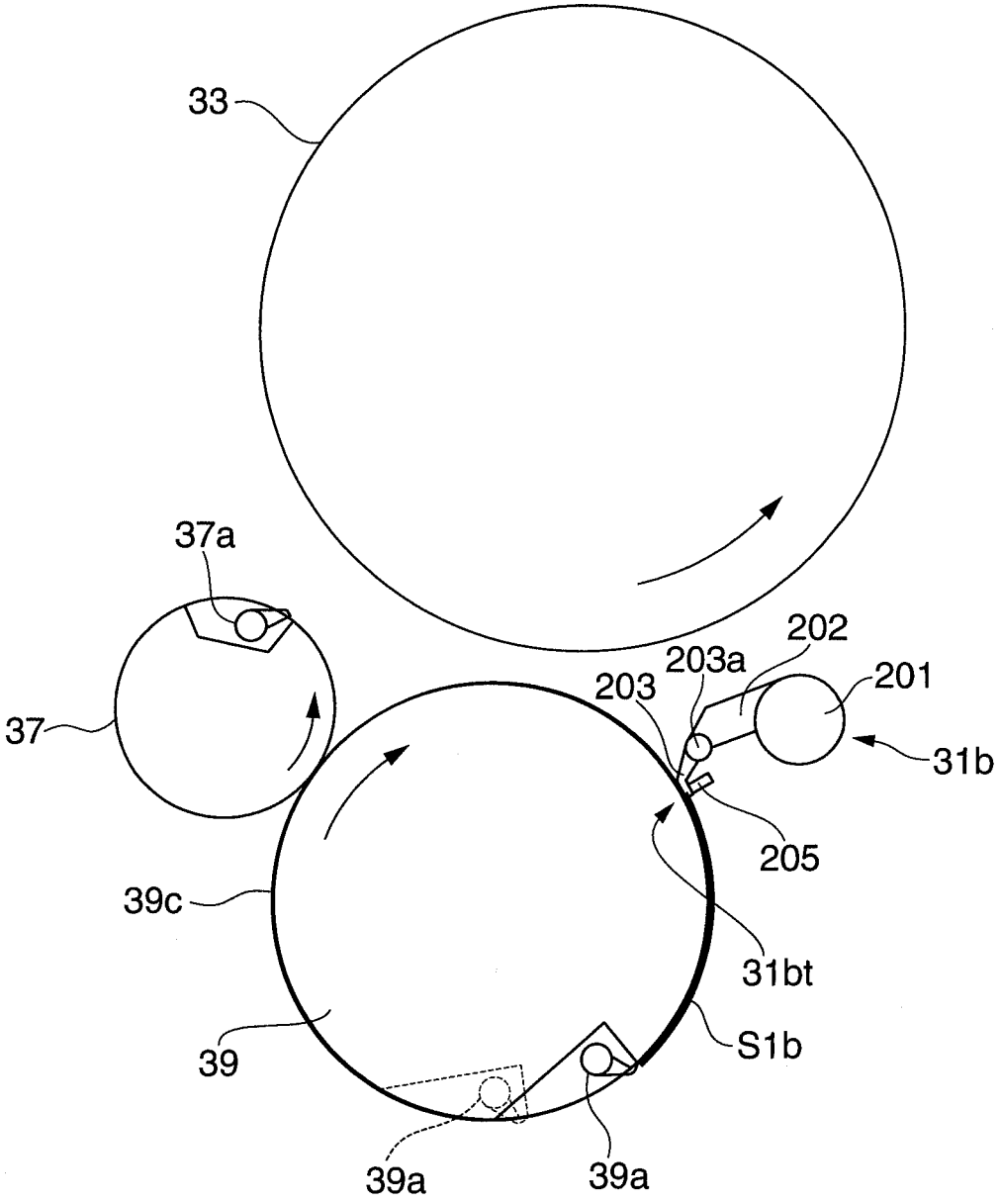
FIG. 9 is a side view for explaining a sheet gripping change operation from the pre-reversal double-diameter cylinder to the reversing swing arm shaft pregripper if the sheet size is smaller than the standard size.

The case wherein the dimension of the sheet S1 in the conveyance direction is smaller than the standard size, as shown in FIG. 9, will be described next. The case of a sheet S1*b* (minimum-sized paper) with a minimum dimension in the conveyance direction, that the digital printing apparatus 1 can print, will be explained. At reception timing t0, transfer timing t3, and reception timing t6, the control unit 251 rotates the pre-reversal double-diameter cylinder 39 at a reference speed (speed v0) equal to that in the case of the sheet S1 with the standard size (middle-sized paper), as indicated by broken lines in FIG. 6. On the other hand, in the first speed adjustment region, the speed of the pre-reversal double-diameter cylinder 39 is controlled to gradually decrease with respect to the reference speed from first adjustment start timing t1, and return to the reference speed at first adjustment end timing t2. Then, in the second speed adjustment region, the speed of the pre-reversal double-diameter cylinder 39 is controlled to gradually increase with respect to the reference speed from second adjustment start timing t4, and return to the reference speed at second adjustment end timing t5. Note that the control unit 251 rotates the pre-reversal double-diameter cylinder 39 at the reference speed (speed v0) in the interval from reception timing t0 to first adjustment start timing t1, that from first adjustment end timing t2 to second adjustment start timing t4, and that from second adjustment end timing t5 to reception timing t6.

In this case, at reception timing t0 and transfer timing t3, the pre-reversal double-diameter cylinder 39 performs reception and transfer operations while rotating at the reference speed, thus allowing a reliable gripping change of the sheet S1*b*.

Normally, when minimum-sized paper with a small size is transferred by a gripping change from the pre-reversal double-diameter cylinder 39 to the reversing swing arm shaft pregripper 31*b*, the gripper device 39*a* of the pre-reversal double-diameter cylinder 39 is set at a position, indicated by a broken line in FIG. 9, at transfer timing t3 as the pre-reversal double-diameter cylinder 39 rotates while its rotation speed is kept at the constant speed v0 (reference speed). In this case, the trailing edge of the sheet S1*b* has already passed through the reversing gripper device 31*bt* of the reversing swing arm shaft pregripper 31*b* set at the reception position, and therefore cannot be gripped by the swing arm gripper 203.

However, in the arrangement of this embodiment, in the first speed adjustment region, the pre-reversal double-diameter cylinder 39 is decelerated from the reference speed to retard the phase of the pre-reversal double-diameter cylinder 39 more than that of the digital printing apparatus 1, thereby setting the gripper device 39*a* of the pre-reversal double-diameter cylinder 39 at a position, indicated by a solid line in FIG. 9, at transfer timing t3. Upon this operation, the trailing edge of the sheet S1*b* is opposed to the reversing gripper device 31*bt* of the reversing swing arm shaft pregripper 31*b* set at the reception position.

By controlling the speed of the pre-reversal double-diameter cylinder 39 in this way, the trailing edge of the sheet S1*b* is gripped by the reversing gripper device 31*bt* of the reversing swing arm shaft pregripper 31*b*, and holding of the leading edge of the sheet S1*b* is canceled by the gripper device 39*a* of the pre-reversal double-diameter cylinder 39 at the same time. With this operation, the sheet S1*b* is transferred by a gripping change from the pre-reversal double-diameter cylinder 39 to the reversing swing arm shaft pregripper 31*b*. The reversing swing arm shaft pregripper 31*b* then swings from the reception position to the transfer position, and transfers the turned sheet S1*b* onto the printing cylinder 33, as shown in FIG. 5E.

After the trailing edge of the sheet S1*a* (minimum-sized paper) is transferred by a gripping change from the pre-reversal double-diameter cylinder 39 to the reversing swing arm shaft pregripper 31*b* at transfer timing t3, the control unit 251 rotates the pre-reversal double-diameter cylinder 39 at the speed v0 (reference speed). Then, in the second speed adjustment region, the pre-reversal double-diameter cylinder 39 is accelerated from the reference speed to advance the phase of the pre-reversal double-diameter cylinder 39, which has retarded more than that of the digital printing apparatus 1. Upon such phase control, at reception timing t6, the gripper device 39*a* of the pre-reversal double-diameter cylinder 39 is opposed to the gripper device 37*a* of the delivery-side transfer cylinder 37, as shown in FIG. 2. With this operation, the leading edge of the sheet S1*b* is transferred by a gripping change from the gripper device 37*a* of the delivery-side transfer cylinder 37 to the gripper device 39*a* of the pre-reversal double-diameter cylinder 39.

With this arrangement, the control unit 251 increases/decreases the rotation speed of the pre-reversal double-diameter cylinder 39 to control (adjust) the phase of the pre-reversal double-diameter cylinder 39 relative to that of the digital printing apparatus 1 in the first and second speed adjustment regions, that do not influence reception timing t0, transfer timing t3, and reception timing t6 at which a gripping change of the sheet S1*b* (minimum-sized paper) is done.

As described above, even if a sheet S1*b* with a dimension in the conveyance direction, which is smaller than the standard size, is used, the leading edge of the sheet S1*b* can reliably be transferred by a gripping change from the delivery-side transfer cylinder 37 to the pre-reversal double-diameter cylinder 39 by increasing/decreasing the rotation speed of the pre-reversal double-diameter cylinder 39. Also, the trailing edge of the sheet S1*b* can reliably be transferred by a gripping change from the pre-reversal double-diameter cylinder 39 to the reversing swing arm shaft pregripper 31*b*.

Figure 10:
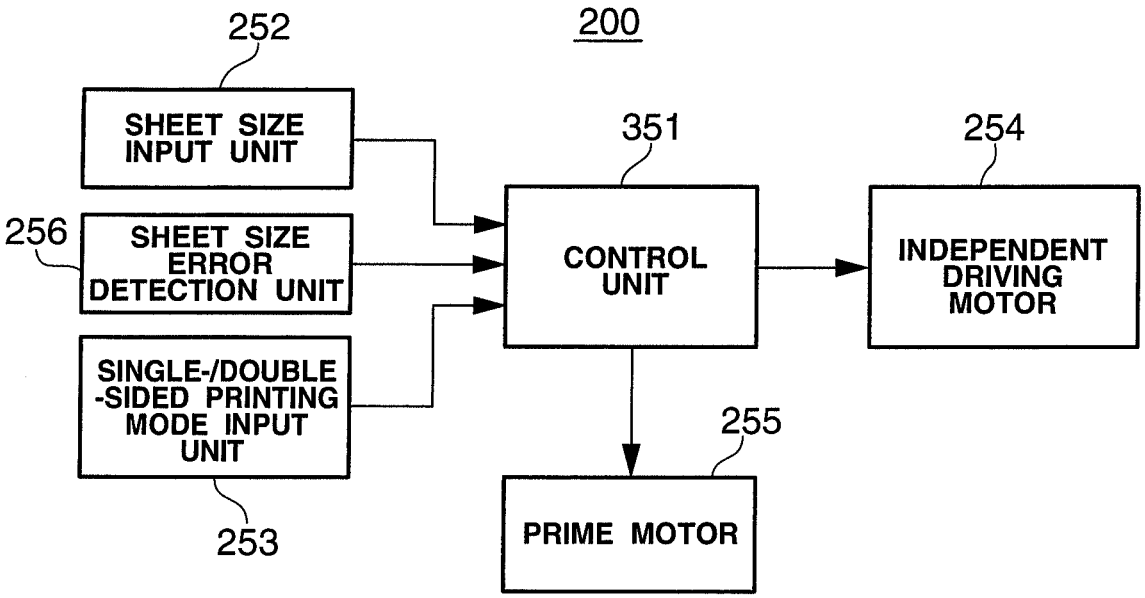
FIG. 10 is a circuit block diagram according to the second embodiment of the present invention, in which the speed of a pre-reversal double-diameter cylinder is controlled in consideration of an error of the sheet size.

Then, as shown in FIG. 10, as the reversing swing arm shaft pregripper 31*b* swings from a reception position indicated by a broken line to a transfer position indicated by a solid line, the sheet S1 (sheet S1, S1*a*, or S1*b*) with its trailing edge leading is conveyed onto the printing cylinder 33. At this time, the trailing edge of the turned sheet S1 is transferred by a gripping change from the reversing gripper device 31*bt* of the reversing swing arm shaft pregripper 31*b* to one of the gripper devices 33*a* to 33*c*.

The gripper devices 33*a* to 33*c* of the printing cylinder 33 alternately hold a new sheet S1 conveyed from the feed-side transfer cylinder 32. The reversing swing arm shaft pregripper 31*b* is positioned at the transfer position at the timing at which it is opposed to the printing cylinder gripper devices 33*a* to 33*c* which hold no new sheet S1, and the trailing edge of the sheet S1 is transferred from the reversing gripper device 31*bt* to the printing cylinder gripper devices 33*a* to 33*c*. With this operation, a new sheet S1 transferred from the feed-side transfer cylinder 32, and a turned sheet S1 transferred from the reversing gripper device 31*bt* of the reversing swing arm shaft pregripper 31*b* are alternately held by the printing cylinder gripper devices 33*a* to 33*c* of the printing cylinder 33, and are conveyed to the inkjet nozzle portion 34.

The trailing edge of the turned sheet S1 transferred from the reversing gripper device 31*bt* of the reversing swing arm shaft pregripper 31*b* is held and conveyed by the gripper devices 33*a* to 33*c* of the printing cylinder 33 while the surface (the obverse surface having undergone a digital printing process) of the sheet S1, which has already undergone a digital printing process by the inkjet nozzle portion 34, is in contact with the support surfaces 33*d*, 33*e*, and 33*f* of the printing cylinder 33, and the surface (the reverse surface having undergone no digital printing process) of the sheet S1, which has not yet undergone a digital printing process, is exposed. The inkjet nozzle portion 34 performs a digital printing process on the reverse surface of the sheet S1 conveyed in tight contact with the circumferential surface of the printing cylinder 33 in a turned state.

The control unit 251 controls the inkjet nozzle heads 34*a* to 34*d* of the inkjet nozzle portion 34 to perform reverse printing on the turned sheet S1 transferred from the reversing gripper device 31*bt* of the reversing swing arm shaft pregripper 31*b*, and perform obverse printing on the new sheet S1 alternately held by the printing cylinder gripper devices 33*a* to 33*c* of the printing cylinder 33. With this operation, the inkjet nozzle heads 34*a* to 34*d* alternately perform obverse printing and reverse printing in correspondence with the new sheet S1 and turned sheet S1 alternately held by the printing cylinder 33.

The sheet S1 having undergone reverse printing on its reverse surface is discharged from the delivery belt 40 onto the pile board 41 sequentially through the delivery-side transfer cylinders 36 and 37, and delivery cylinder 38, as in the single-sided printing mode.

According to this embodiment, even if a sheet S1*a* or S1*b* with a dimension in the sheet conveyance direction, which is larger or smaller than that of the standard size (middle-sized paper), is used, the independent driving motor 254 is controlled to increase/decrease (adjust) the rotation speed of the pre-reversal double-diameter cylinder 39 based on the dimension in the sheet conveyance direction. It is therefore possible to reliably receive the leading edge of the sheet S1 from the delivery-side transfer cylinder 37 to the pre-reversal double-diameter cylinder 39, and transfer the trailing edge of the sheet S1 from the pre-reversal double-diameter cylinder 39 to the reversing swing arm shaft pregripper 31*b*. This obviates the need for mechanical adjustment that accompanies a change in sheet size to relieve the operator's burden. This also obviates the need for a preparatory operation to improve the productivity.

Also, the sheet S1 is sequentially transferred to the feed-side transfer cylinder 32, printing cylinder 33, delivery-side transfer cylinders 36 and 37, pre-reversal double-diameter cylinder 39, and reversing swing arm shaft pregripper 31*b* by a gripping change by the gripper devices. This makes it possible to obtain high registration accuracy and high obverse/reverse registration accuracy of the obverse and reverse surfaces of the sheet S1 in the conveyance direction or widthwise direction of the sheet S1, thus improving the printing quality of the sheet S1.

(2) Second Embodiment

The second embodiment is the same as the first embodiment except for the configuration of the control block of the digital printing apparatus 1. Only a control block of a digital printing apparatus 200 according to the second embodiment will be described below.

<Configuration of Control System for Digital Printing Apparatus>

The digital printing apparatus 200 includes a control unit 351 having a CPU configuration which controls the overall printing operation, as shown in FIG. 10. The control unit 351 is connected to a sheet size input unit 252 which receives the sheet size as standard information, a sheet size error detection unit 255 which includes a photoelectric sensor arranged near a printing cylinder 33, a single-/double-sided printing mode input unit 253 which selects a single- or double-sided printing mode, an independent driving motor 254, and a prime motor 255. The sheet size error detection unit 255 detects an error of the sheet size, that is, the dimension in the conveyance direction, which is actually printed for standard data input via the sheet size input unit 252.

The control unit 351 receives signals output from the sheet size input unit 252, sheet size error detection unit 255, and single-/double-sided printing mode input unit 253 to control the independent driving motor 254. Differences from the first embodiment lie in that the sheet size input unit 252 receives the sheet size as standard information, and the sheet size error detection unit 255 is provided.

<Operation of Adjusting Rotation Speed of Pre-Reversal Double-Diameter Cylinder>

The control unit 351 recognizes the sheet S1 as one of a sheet S1 with a standard size (middle-sized paper), a sheet S1*a* (maximum-sized paper) with a large dimension in the conveyance direction, and a sheet S1*b* (minimum-sized paper) with a small dimension in the conveyance direction, based on the standard information (middle-sized paper, maximum-sized paper, or minimum-sized paper) of the sheet S1 input to the sheet size input unit 252.

The sheet size error detection unit 255 detects errors of the sheet sizes (sheet conveyance direction) for three types of standard information for the first sheet S1 (middle-sized paper), sheet S1*a* (maximum-sized paper), or sheet S1*b* (minimum-sized paper) supplied for each lot, and sends these errors to the control unit 351. The control unit 351 adds/subtracts one (error data corresponding to input standard information) of three types of error data input from the sheet size error detection unit 255 to/from standard information (one of middle-sized paper, maximum-sized paper, and minimum-sized paper), and determines the actual size of the sheet. The control unit 351 controls driving of the independent driving motor 254 to increase/decrease the rotation speed of a pre-reversal double-diameter cylinder 39 based on the obtained actual size of the sheet.

With this operation, the leading edge of the sheet S1*a* from a delivery-side transfer cylinder 37 can reliably be received by a gripping change by the pre-reversal double-diameter cylinder 39, regardless of the sheet size. Also, the trailing edge of the sheet S1*a* can reliably be transferred by a gripping change from the pre-reversal double-diameter cylinder 39 to a reversing swing arm shaft pregripper 31*b*.

Note that by sending, in advance, standard information input from the control unit 351 to the sheet size input unit 252, the sheet size error detection unit 255 may detect only error information for the sent standard information and output it to the control unit 351.

(3) Third Embodiment

Only a control block of a digital printing apparatus 300 according to the third embodiment will be described below.

<Configuration of Control System for Digital Printing Apparatus>

Figure 11:
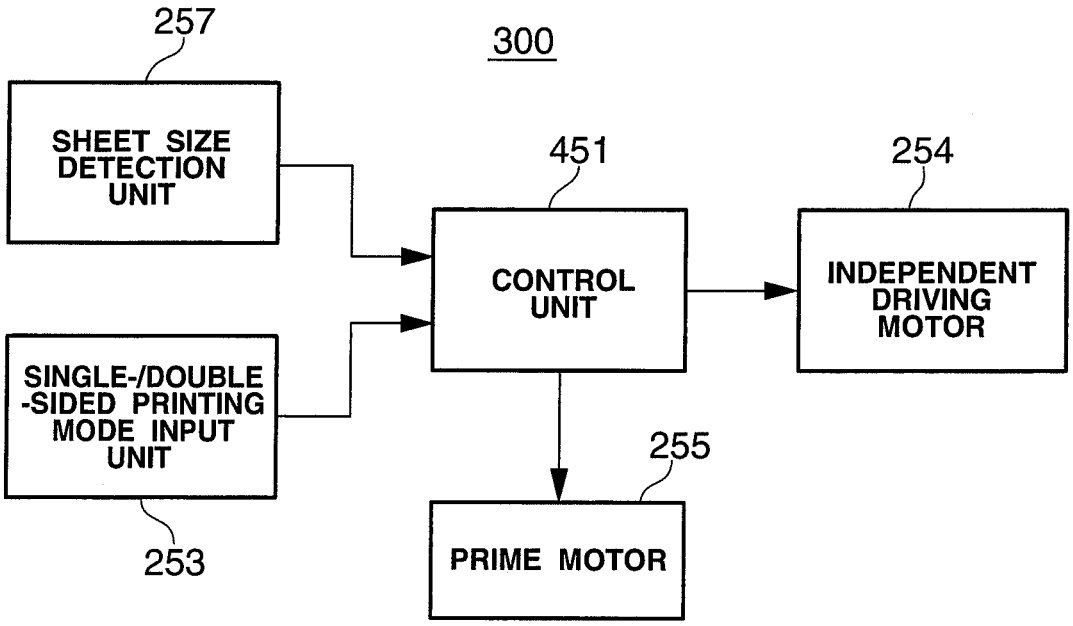
FIG. 11 is a circuit block diagram according to the third embodiment of the present invention, in which the speed of a pre-reversal double-diameter cylinder is controlled in consideration of the actual measurement value of the sheet size.

The digital printing apparatus 300 includes a control unit 451 having a CPU configuration which controls the overall printing operation, as shown in FIG. 11. The control unit 451 is connected to a sheet size detection unit 257 arranged near a printing cylinder 33, a single-/double-sided printing mode input unit 253 which selects a single- or double-sided printing mode, an independent driving motor 254, and a prime motor 255. The sheet size detection unit 257 detects the dimension in the conveyance direction (size). A difference from the first embodiment lies in that the sheet size detection unit 257 is provided in place of the sheet size input unit 257.

<Operation of Adjusting Rotation Speed of Pre-Reversal Double-diameter Cylinder>

The sheet size detection unit 257 detects the dimension, in the conveyance direction, of a sheet S1 conveyed by a pre-reversal double-diameter cylinder 39, and outputs it to the control unit 451. The control unit 451 recognizes the dimension of each sheet S1 in the conveyance direction based on the output from the sheet size detection unit 257. The control unit 451 controls the independent driving motor 254 to increase/decrease the rotation speed of the pre-reversal double-diameter cylinder 39 based on the measurement data of the sheet S1 detected by the sheet size detection unit 257, that is, the actual size of the sheet S1. With this operation, the leading edge of the sheet S1 from a delivery-side transfer cylinder 37 can reliably be received by a gripping change by the pre-reversal double-diameter cylinder 39, regardless of the sheet size. Also, the trailing edge of the sheet S1 can reliably be transferred by a gripping change from the pre-reversal double-diameter cylinder 39 to a reversing swing arm shaft pregripper 31*b*.

(4) Other Embodiments

Although a sheet conveyance device is applied to the digital printing apparatus 1 (sheet processing apparatus) in the above-mentioned embodiment, the present invention is not limited to this. The sheet conveyance device according to the present invention may also be applied to, for example, an offset print process apparatus, inspection process apparatus, foil transfer process apparatus, and embossing process apparatus as other sheet processing apparatuses.

Also, assuming that a sheet S1 (middle-sized paper) has a standard size, the rotation speed of the pre-reversal double-diameter cylinder 39 is increased/decreased when sheets S1*a* and S1*b* with sizes in the sheet conveyance direction, which are larger and smaller than the standard size, are conveyed. The present invention is not limited to this, and assuming that a sheet S1*a* with a maximum dimension in the conveyance direction has a standard size, the rotation speed of the pre-reversal double-diameter cylinder 39 may be adjusted when a sheet with a dimension in the sheet conveyance direction, which is smaller than the standard size, is conveyed. Also, assuming that a sheet S1*b* with a minimum dimension in the conveyance direction has a standard size, the rotation speed of the pre-reversal double-diameter cylinder 39 may be adjusted when a sheet with a dimension in the sheet conveyance direction, which is larger than the standard size, is conveyed.

Moreover, although the printing cylinder 33 implemented by a triple-diameter cylinder is used in the above-mentioned embodiments, the present invention is not limited to this, and a printing cylinder implemented by a double-, quadrupole- or sextuple-diameter cylinder may be used.

What is claimed is:

1. A sheet conveyance device comprising:

a first conveyance unit which includes a first holder that holds a leading edge of a sheet with respect to a conveyance direction, and conveys the sheet held by said first holder;

a second conveyance unit which includes a second holder that holds a leading edge of the sheet with respect to a conveyance direction, and conveys the sheet held by said second holder;

a third conveyance unit which is supported to be swingable between a reception position at which said third conveyance unit receives the sheet from said first conveyance unit, and a transfer position at which said third conveyance unit transfers the sheet to said second conveyance unit, said third conveyance unit including a third holder that holds a trailing edge of the sheet with respect to the conveyance direction while the sheet is being conveyed by said first conveyance unit, and said third conveyance unit configured to receive by said third holder the trailing edge of the sheet conveyed by said first conveyance unit, to rotate in a first direction directed from the reception position to the transfer position, to transfer the received trailing edge of the sheet to said second holder of said second conveyance unit by a gripping change, and to rotate in a second direction opposite to the first direction;

an independent driving unit which independently drives said first conveyance unit;

a device driving unit which drives an entire device including said second conveyance unit and said third conveyance unit; and a control unit which controls said independent driving unit to adjust a speed at which said first conveyance unit conveys the sheet, based on a dimension of the sheet in a conveyance direction.

2. A device according to claim 1, wherein said first conveyance unit includes a rotatably supported transport cylinder, and said independent driving unit includes an independent driving motor which drives said transport cylinder independently of a device driving system.

3. A device according to claim 2, further comprising:

a fourth conveyance unit which is arranged on an upstream side of said transport cylinder in a sheet conveyance direction, includes a fourth holder that holds a leading edge of the sheet with respect to a conveyance direction, and transfers the sheet held by said fourth holder to said first holder of said transport cylinder, wherein said control unit controls said independent driving motor to adjust a rotation speed of said transport cylinder in accordance with the dimension of the sheet in the conveyance direction so that the trailing edge of the sheet conveyed by said transport cylinder is opposed to said third holder when said third conveyance unit is set at the sheet reception position, and said fourth holder of said fourth conveyance unit is opposed to said first holder of said first conveyance unit after the sheet is transferred to said third holder.

4. A device according to claim 3, wherein if the dimension of the sheet in the conveyance direction is larger than a reference size, said control unit controls said independent driving motor to set the rotation speed of said transport cylinder higher than a reference speed after the sheet is received from said fourth conveyance unit, and then set the rotation speed of said transport cylinder lower than the reference speed after the sheet is transferred from said transport cylinder to said third conveyance unit, and if the dimension of the sheet in the conveyance direction is smaller than the reference size, said control unit controls said independent driving motor to set the rotation speed of said transport cylinder lower than the reference speed after the sheet is received from said fourth conveyance unit, and then set the rotation speed of said transport cylinder higher than the reference speed after the sheet is transferred from said transport cylinder to said third conveyance unit.

5. A device according to claim 3, wherein said control unit controls said independent driving motor to set the rotation speed of said transport cylinder to a reference speed when the sheet is transferred from said transport cylinder to said third conveyance unit, and the sheet is transferred from said fourth conveyance unit onto said transport cylinder.

6. A device according to claim 3, wherein if the dimension of the sheet in the conveyance direction is a reference size, said control unit controls said independent driving motor to rotate said transport cylinder at a reference speed.

7. A device according to claim 1, further comprising a sheet size input unit to which a dimension of the sheet in the conveyance direction is input, wherein said control unit controls said independent driving unit based on the dimension of the sheet in the conveyance direction output from said sheet size input unit.

8. A device according to claim 7, further comprising an error detection unit which detects an error of a difference between the dimension of the sheet conveyed from said second unit to said third conveyance unit in the conveyance direction and standard information of the dimension of the sheet in the conveyance direction and outputs error information, wherein standard information of the dimension of the sheet in the conveyance direction is input to said sheet size input unit, and said control unit controls said independent driving unit based on the standard information output from said sheet size input unit and the error information output from said error detection unit.

* * * * *